US005812088A

United States Patent [19]

Pi et al.

[11] Patent Number: 5,812,088

[45] Date of Patent: Sep. 22, 1998

[54] BEAM FORMING NETWORK FOR RADIOFREQUENCY ANTENNAS

[75] Inventors: Franceso Coromina Pi, Rijnsburg; Javier Ventura-Traveset Bosch, Leiden; Mike Yarwood, Noordwijk; Wolfgang Bosch, Rijnsburg, all of Netherlands

[73] Assignee: Agence Spatiale Europeenne, Paris, France

[21] Appl. No.: 573,361

[22] Filed: Dec. 15, 1995

[30] Foreign Application Priority Data

Dec. 19, 1994 [FR] France ..... 95 15229

[51] Int. Cl.[6] ..... H01Q 3/22; H01Q 3/24; H01Q 3/26

[52] U.S. Cl. ..... 342/373

[58] Field of Search ..... 342/373, 196, 342/81

[56] References Cited

U.S. PATENT DOCUMENTS

| | | | |
|---|---|---|---|
| 4,231,040 | 10/1980 | Walker . | |
| 4,356,461 | 10/1982 | Acoraci | 333/116 |
| 4,424,500 | 1/1984 | Viola et al. | 333/128 |
| 4,901,085 | 2/1990 | Spring et al. | 342/373 |
| 4,907,004 | 3/1990 | Zacharatos et al. | 342/373 |
| 4,989,011 | 1/1991 | Rosen et al. | 342/373 |

FOREIGN PATENT DOCUMENTS 0420739 9/1990 European Pat. Off. .

OTHER PUBLICATIONS

Proceedings of the IEEE, vol. 67, No 6, Jun. 1979 New York US, pp. 930–949, Mersereu "The Processing of Hexagonally . . . . signals ".

Antenna Applications Symposium, 23 Sep. 1981–25 Sep. 1981 Monticello, Il, USA Chadwick, et al. "An algebraic . . . ".

French Search Report (dated Sep. 22, 1995) 2 pages.

*Primary Examiner*—Theodore M. Blum

*Attorney, Agent, or Firm*—Sughrue, Mion, Zinn, Macpeak & Seas, PLLC

[57] ABSTRACT

The invention concerns a beam forming network for radiofrequency antennas and applying to the input signals a two-dimensional hexagonal discrete Fourier transform in order to control radiating elements for generating multiple beams. The number of inputs and outputs is equal to $N_t$ with $N_t=R\times N^2$, R and N being integers. A first circuit layer comprises a row of $N^2$ cells each having R inputs and R outputs, each cell receiving a signal present at one of said $N_t$ inputs and applying to the signals present at its R inputs a one-dimensional R×R discrete Fourier transform, and a second circuit layer comprises R independent sets of cells each having N inputs and N outputs, each set including a first row and a second row of N cells, each cell applying to the signals present at its N inputs a one-dimensional R×R discrete Fourier transform.

The invention also concerns a hardware structure for a network of this kind.

22 Claims, 13 Drawing Sheets

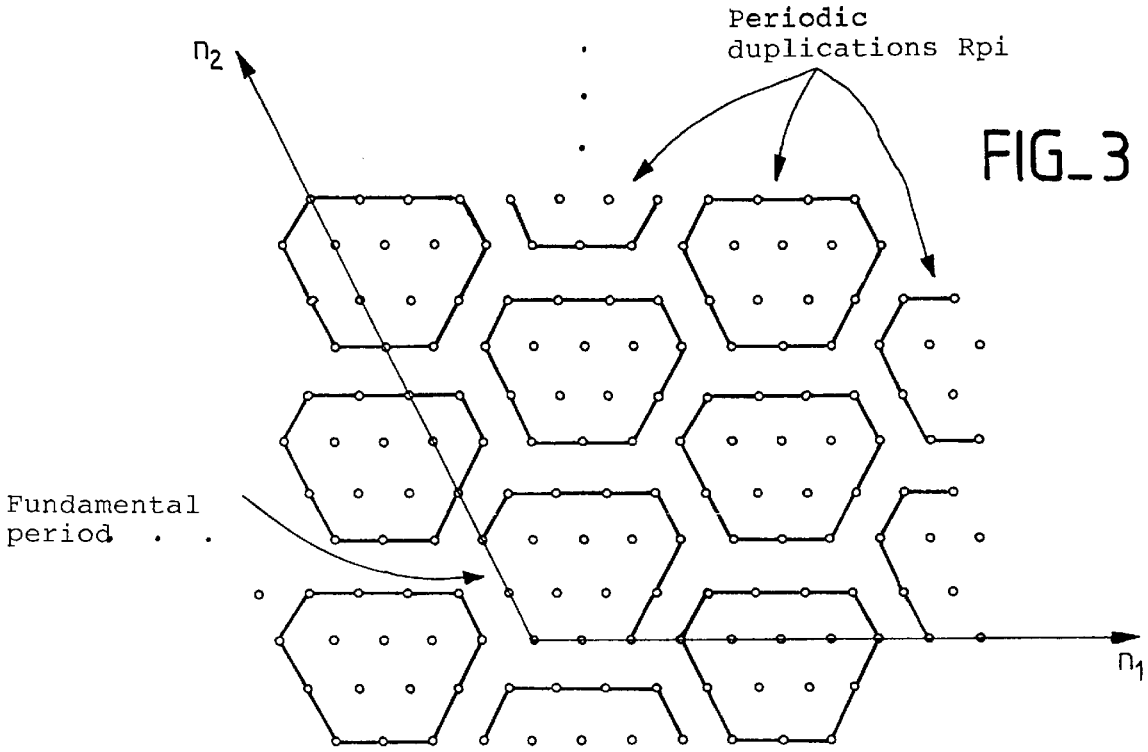
FIG_3
FIG_4
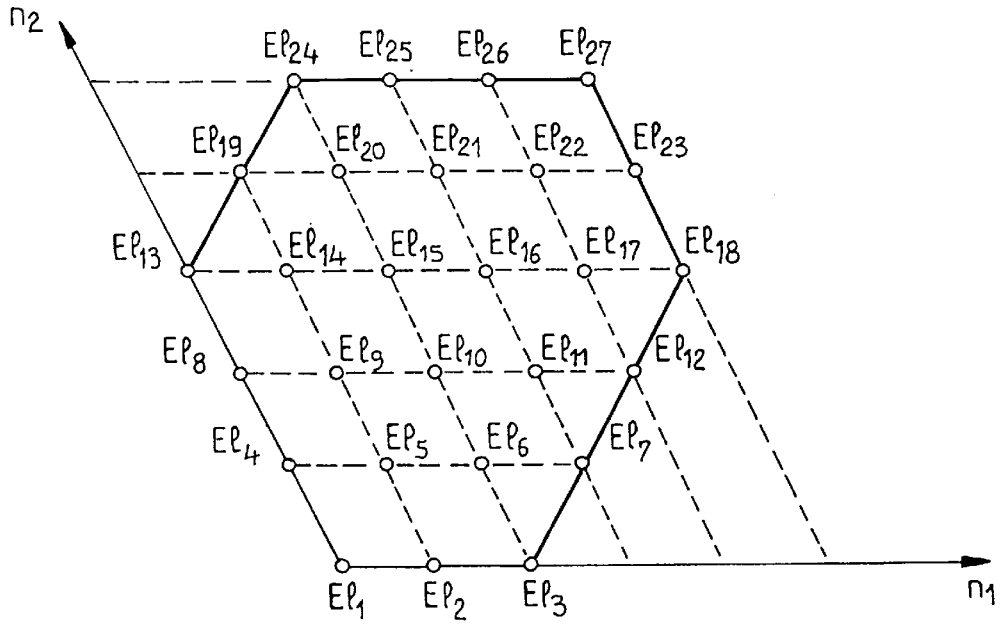

CFH 4
1
2
3
JEU-4
41
42
43
44
45
46
47
48
49
11
12
13
14
15
16
21
22
23
24
25
26
31
32
33
34
35
36
3X3
0°
40°
80°
160°
111
112
113
121
122
123
131
132
133
211
212
213
221
222
223
231
232
233
311
312
313
321
322
323
331
332
333
CLC1
CLC2
CLC3
-1
-2
-3
4a

Outputs
El1-El27
Cells
14à36
3X3
CLC1
CLC2
CLC3
ROW/
COLUMN
CONNECTIONS
Cells
11à33
CFH
4a
4
PCB
Inputs
e1 - e27

BEAM FORMING NETWORK FOR RADIOFREQUENCY ANTENNAS

BACKGROUND OF THE INVENTION

1. Field of the Invention

The invention concerns a beam forming network for radiofrequency antennas utilizing the Fast Fourier Transform (FFT).

It also concerns a hardware structure for a network of this kind.

The invention applies advantageously, although not exclusively, to phased array antennas for generating multiple beams in applications on board satellites.

2. Description of the Prior Art

Conventional radiofrequency beam forming networks for applications involving a large number of synthesized beams and a large number of radiating elements in the antenna cannot be used because of their mass. Instead, intermediate frequency ("IF") beam forming networks are used, or even baseband digital beam forming networks, with implications in respect of power consumption.

The article by P. S. Hall and S. J. Vetterlein: "Review of Radio Frequency Beamforming Techniques for Scanned and Multiple Beam Antennas", pages 293–303, "IEE Proceedings", Vol. 137, PL. H., No. 5, October 1990 reviews the main techniques used to form radiofrequency beams.

These include the "Butler Matrix" technique described in section 4.2 of the article (see also FIG. 15), producing a compact layout with a minimum of coupling circuits. Butler matrices arc appropriate for linear networks. In the case of planar phased arrayed networks utilizing rectangular arrangements of radiating elements, the bean forming network can also use linear Butler matrices.

However, the maximal size of a Butler matrix (and thus the maximum number of beams and the maximum number of radiating elements of the antenna) is limited by various factors, as indicated below:

1) Manufacturing tolerances: as the size of the matrix increases, the frequency difference between adjacent radiating elements becomes smaller. Closer control of phase characteristics is then necessary. As indicated in the article mentioned above, it can be assumed that the maximal size of a Butler matrix using the microstrip technology is 64×64.

2) The complex topology of the connections (routing) between layers of couplers: as is readily apparent in FIG. 3 appended to this description, a complex routing of connecting lines is needed for a 16×16 Butler matrix. The circuits of the Butler matrix beam forming network are divided between two levels (Levels 1 and 2), each comprising four cells $Ce1_1$ through $Ce1_4$ and $Ce1'_1$ through $Ce1'_4$, respectively. Sixteen connections 1' through 16' correspond to the connections 1 through 16. A very high level of electrical insulation is required between these connections. This complexity makes it difficult to implement planar technologies (stripline waveguides, microstrip lines).

3) Requirements concerning transitions between beams: for a linear array antenna comprising N radiating elements, an N×N Butter matrix beam forming network generates a set of N beams with transition levels of −4 dB.

This level is definitely too low for the preferred applications intended for the invention, normally space related applications. A level in the order of −1 dB is required. One well known solution is to uprate the beam forming network and to use only part of the matrix. Using a 2N×2N matrix, for example, a transition level of −1.5 dB is obtained.

It is obvious, however, that uprating the Butler matrix beam forming network has a direct impact on its mass and on its manufacturing tolerances and increases the problems associated with the complexity of the connections.

Furthermore, space applications normally utilize array antennas with a hexagonal grid rather than a rectangular topology. This is more efficient in terms of compactness: it is well known that the number of radiating elements required is smaller, for the same coverage. However, in this case a simple layout of the row/column type as described with reference to Butler matrix beam forming networks is no longer possible.

Another configuration is proposed by G. G. Chadwick et al. in: "An Algebraic Synthesis Method for $RN^2$ Multibeam Matrix Network", published in "Antenna Applications Symposium", Monticello (Illinois, U.S.A.), 23–25 Sep. 1981, "Proceedings". This configuration is very similar to the "Butler matrix" concept: in fact these two configurations both represent a direct radiofrequency implementation of the "FFT" algorithm.

Although of interest, this configuration is open to the same remarks as previously with respect to mass, manufacturing tolerances, routing of connections and transition levels between adjacent beams.

As is clear in FIG. 12 of the above-mentioned publication, a large number of phase-shifter circuits on two levels is used. Finally, there is very little modularity in these circuits. Apart from cells with three inputs and three outputs, there are no repetitive modules.

It is well known that in the case of very complex circuits this modularity aspect is very important with respect to manufacturing costs, integration possibilities and ease of testing. For example, a module is naturally easier to manufacture and less costly to replace in the event of an equipment failure than a complex circuit. The prior art technology restricts integration to circuits of a certain size and a certain complexity. Repetitive circuits of relatively low complexity can therefore be implemented as integrated circuits, the reliability of which is usually greater than that of discrete circuits. Finally, although this hardly exhausts the subject, the complexity of test programs increases, generally in a non-linear manner, with the complexity of the circuits to be tested.

To summarize, it can be assumed that the technology of radiofrequency antennas, especially for space applications (antennas on board satellites) imposes a number of constraints, some of which will now be summarized.

The antenna is usually hexagonal in shape. In the context of the invention, the antenna could equally well be triangular in shape.

First and foremost it is necessary to implement an efficient architecture (the term "efficient" is to be understood in terms of technology and reduced complexity). The signal processing algorithm must use the Discrete Fourier Transform ("DFT"). The "DFT" operates on a series of sampled signals feeding radiating elements of the hexagonal antenna so that the coefficients resulting from the "DFT" are also hexagonally sampled in the domain of the transform (i.e. representing the center of the beams).

The requirement concerning hexagonal sampling in the original domain (usually referred to as the "time domain" in the signal processing art) is essentially due to the usually hexagonal shape of the antenna. The requirement concerning hexagonal sampling in the transform domain (usually referred to as the "frequency domain" in the signal processing art) results from the fact that it allows a more efficient coverage when the beams coincide with a hexagonal grid.

An object of the invention is therefore to solve this problem, i.e. to offer an efficient architecture compatible with current integration technologies, this efficiency being expressed in terms of low mass, simple implementation, reliability and ease of testing, and an optimized algorithm, the term "optimized" to be understood in terms of criteria for optimizing the technology, rather than mathematically.

SUMMARY OF THE INVENTION

The invention therefore comprises a beam forming network for radiofrequency antennas having a particular number of radiating elements for generating multiple beams, said beam forming network comprising a particular number of signal inputs, a number of outputs for control signals for said radiating elements equal to said predetermined number of signal inputs and applying to the input signals a two-dimensional hexagonal discrete Fourier transform, wherein said predetermined number of inputs and outputs being equal to $N_t$ with $N_t=R\times N^2$, R and N being integers, the circuits constituting said beam forming network are divided between first and second circuit layers respectively effecting a row one-dimensional discrete Fourier transform and a column one-dimensional discrete Fourier transform;

the first circuit layer comprises a row of $N^2$ cells each having R inputs and R outputs, each cell receiving a signal present at one of said $N_t$ inputs and applying to the signals present at its R inputs a one-dimensional discrete Fourier transform;

the second circuit layer comprises R independent sets of cells each having N inputs and N outputs, each set including a first row and a second row of N cells, each cell applying to the signals present at its N inputs a one-dimensional discrete Fourior transform; each of the outputs of the cells of said second row driving one of said radiating elements;

said first and second circuit layers arc connected by a first set of interconnections providing connections between the outputs of the cells of said row of $N^2$ cells and the inputs of the N cells of the first row of the R independent sets of cells; the outputs of rank i of each cell being each connected to one of the cell inputs of the independent set of the same rank; with $i \in \{1, R\}$;

and said first and second rows of cells of each of said R independent sets are connected by a second set of interconnections providing connections between the outputs of the N cells of the first row and the inputs of the N cells of the second row; the output of rank i of each cell of the first row being connected to an input of the cell of the same rank in the second row; with $j \in \{1, N\}$.

The invention also employs a mechanical structure for laying out a network of this kind.

The invention finally resides in the application of this network to the control of phased array radiofrequency antennas for generating multiple beams, in particular a hexagonal grid antenna on-board a satellite.

BRIEF DESCRIPTION OF THE DRAWINGS

FIG. 3 is a diagram showing the duplication of this unit region over a larger portion of the support.

FIG. 4 is a diagram showing a region of the radiating element support for a 27×27 hexagonal network.

DETAILED DESCRIPTION OF THE PREFERRED EMBODIMENTS

As already mentioned, the constraints of radiofrequency technology include the need to utilize an efficient architecture to apply the "DFT" transform to a two-dimensional series of hexagonally sampled signals (i.e. signal inputs to dan antenna element in a grid shaving a hexagonal topology) so that the resulting coefficients of the "DFT" are also hexagonally sampled in the domain of the transform (representing the center of the beams)

The architecture must have the following characteristics:

1. It must use a row/column breakdown.

2. It must be modular and must use a very small number of functional blocks (one or two blocks) that are repeated and the complexity of which is compatible with the constraints of the integration technologies usually employed in this type of application.

3. It must after an additional degree of modularity so that a plurality of functional blocks can be interconnected to form a "macroblock" that can be used in different parts of the architecture as a whole.

4. The number of phase-shifters associated with the interconnections must be minimized.

The mathematical algorithm utilized in the beam forming network of the invention must be compatible with the architecture constraints just outlined.

We begin by outlining the main properties and characteristics of a hexagonal two-dimensional "DFT" algorithm. Only the aspects necessary to an understanding of the invention are explained in detail, the mathematical basis of this type of transform being well known in itself. Reference may advantageously be had to the previously mentioned article by G. G. Chadwick et al., for example, for a more detailed explanation of this algorithm as applied to radiofrequency phased array antennas.

Figure 1:
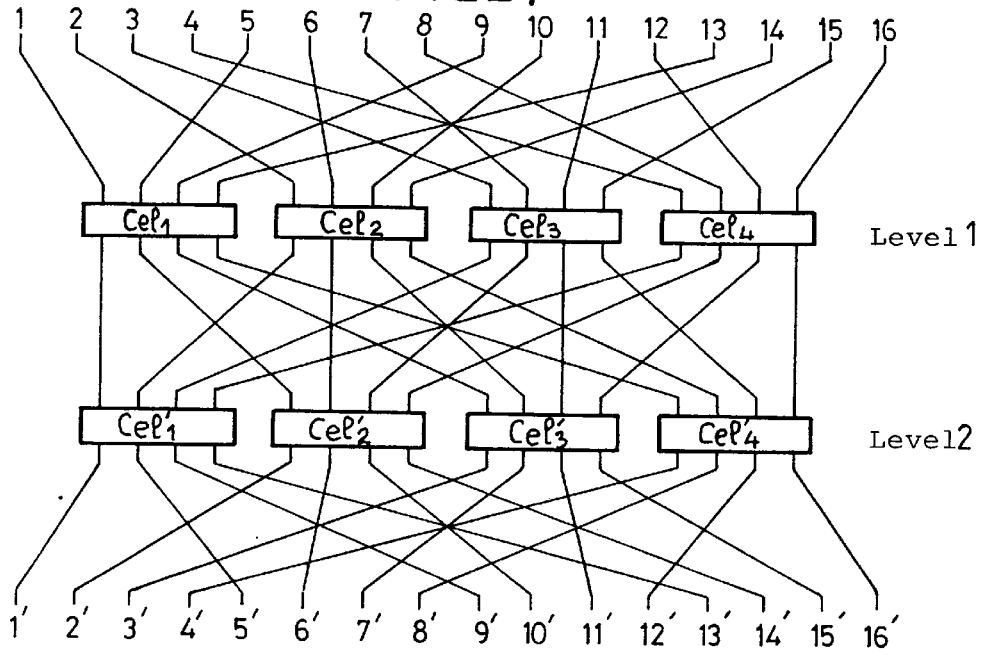
FIG. 1 is a diagram showing a prior art 16×16 Butler matrix beam forming network.
Figure 2:
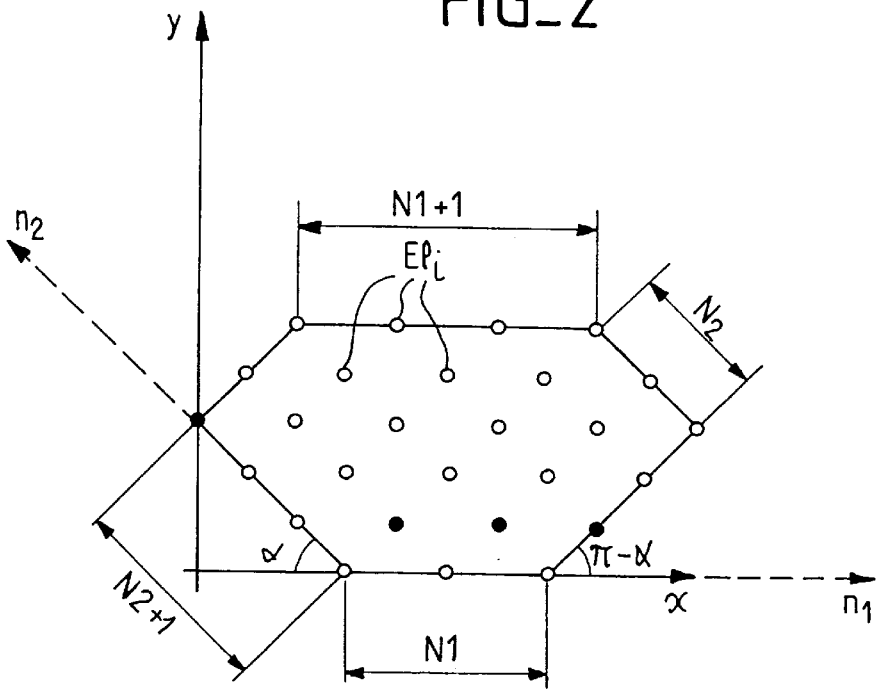
FIG. 2 is a diagram showing the topology of a unit region of the radiating element support of a phased array antenna.

The stops of the algorithm are as follows:

1. It is first necessary to determine the regions of the support of the two transform domains, i.e. to establish how the radiating elements of the antenna are distributed in the two-dimensional origin space and how the centers of the beams are distributed in the two-dimensional transform space. These two support regions are characterized by two numbers $N_1$ and $N_2$ and are substantially hexagonal in shape, as shown in FIG. 2.

The elements $E1_i$ are therefore included within a hexagon with two arbitrary orthonomic axes x and y. The bottom side, with dimension $N_1$, is coincident with the x axis and the top side, with dimension $N_1+1$, is also parallel to the x axis. The lateral sides, with dimensions $N_2$ and $N_2+1$, arc inclined to the x axis at an angle $\alpha$ and an angle $(\pi\cdot\alpha)$, respectively, with $\alpha$ close to 45° in the example described. The slight asymmetry greatly simplifies the explanation of the mathematical computation, but does not impact on the system of the invention since in a real case only the necessary elements inside the support region can be selected, and this region can have a symmetrical shape.

2. In a second step the periodicity of the matrix N is determined. This matrix constitutes a characteristic matrix of the two-dimensional transform used in the context of the invention. It must be selected so that it concerns a hexagonally sampled signal the Fourier transform of which is also a hexagonally sampled signal.

This matrix can take the following form:

$$N = \begin{bmatrix} N_1 + N_2 & N_2 \\ N_2 & 2N_2 \end{bmatrix} \tag{1}$$

3. In a third step the Discrete (Direct) Fourier Transform and the Inverse Fourier Transform are written: "DFT" and "IDFT". They can be determined from the following equations:

$$x(n) = \frac{1}{|det(N)|} \sum_{k\epsilon L_{I/N}} X(k) x \exp(jk^T(2\pi N^{-1})n \tag{2}$$

with $n\epsilon L_{I/N}$ $$X(k) = \sum_{k\epsilon L_{I/N}} X(n) x \exp(-jk^T(2\pi N^{-1})n \tag{3}$$

with $k\epsilon L_{I/N^T}$

The expression $L_{I/N}$ is an algebraic series called the series of residues modulo n of the algebraic series LI, which is a two-dimensional trellis of integer numbers. In particular, $L_{I/N}$ is a series of equivalent classes the generic class [n] of which is given by the expression:

$$[n]=\{m,\ n\epsilon L_I \text{ such that } n=m \pmod N\} \tag{4}$$

[n] being one possible representation of this class.

Similarly $L_{I/N}{}^T$ is a series of residues modulo $N^T$ of LI and therefore a series of equivalence classes for which a generic class [k] is given by the expression:

$$[k]=\{j,\ k\epsilon L_I \text{ such that } k=j \pmod{N^T}\} \tag{5}$$

[k] being one possible representation of this class.

Consider one of the series, for example the series $L_{I/N}$. The number of classes of residues of the series $L_{I/N}$ is called the index of $L_I$ in $L_N$. The number of classes of residues and therefore of points to consider in equation (3) becomes equal to $|\det(N)|$, which is in turn equal to $[(2N_1\times N_2)+N_2{}^2]$ (see equation (1)). There is an infinite choice of series representative of $L_{I/N}$ since the number of representations of a given equivalent class is infinite.

In a fourth stop the input values x(n) of equation (3) are determined (or alternatively the input values X(k) of equation (2)).

The procedure is as follows (only the determination of x(n) is illustrated, since the equivalent operations are used to determine X(k)):

a) In a two-dimensional space comprising the radiating elements as shown in FIG. 2, two new axes $n_1$ and $n_2$ are defined, $n_1$ being coincident with the axis x and $n_2$ being at an angle $\alpha$ to that axis (i.e. coincident with the hexagon side of dimension $N_2+1$). Also, each radiating element is assigned coordinates relative to these two axes: $x(n_1, n_2)$.

b) A periodic extension of the signal $x(n_1, n_2)$ is then generated, as shown in FIG. 3 in particular ($Rp_i$ duplications) by generating repetitions of the original signal defined as:

$$x(n_1\cdot(r_1\times N_2+r_2\times(N_1+N_2),\ n_2-(r_1\times 2N_2+r_2\times N_2));$$

$N_1$ and $N_2$ being the integer numbers previously defined and $r_1$ and $r_2$ being arbitrary numbers, the coordinates of which are relative to the axes $n_1$ and $n_2$. These repetitions cover all of the two-dimensional space. The initial set of points $x(n_1, n_2)$, before repetition, is called the fundamental period. The following equation applies:

$$x(n_1, n_2)=x(n_1\cdot(r_1\times N_2+r_1\times(N_1+N_2)),\ n_2\cdot(r_1\times 2N_2+r_2\times N_2)\ ) \tag{6}$$

$r_1$ and $r_2$ being arbitrary integers.

c) Finally, a correspondence may be made between x(n) and x(n(1)) and x(n(2)) in the extended representation, n(1) and n(2) being defined as the two coordinates which define the representation of the equivalence classes [n] of $L_{I/N}$.

$$X(n)=x(n(1), n(2)) \tag{7}$$

with n=n(1), n(2)

Given this result, it is possible to determine an architecture for the beam forming network of the invention. The previous stages can be summarized as follows:

a) Determination of the elements (set of representations [n]) of $L_{I/N}$ (or alternatively of $L_{I/N}{}^T$);

b) Determination of the values of x(n) from equation (3) (or alternatively of X(k) from equation (2));

c) Application of equation (2) for the "DFT" (Direct) or for the "IDFT".

Thus far, the procedure has merely been a reformulation of the problem using an appropriate algebraic representation. In reality, the "DFT" of equation (2) does not always use a fast algorithm and, consequently, does not satisfy any of the criteria that apply to the invention.

Since the periodicity matrix (equation (1)) is not a diagonal matrix, it is not possible to do a row/column decomposition in equation (2), which is the first condition imposed by the invention for obtaining an efficient layout.

The following steps are required to solve this first problem:

a) Decomposition of the periodic matrix N into what is known as a Smith normal form. This decomposition is always possible. The result is a matrix equation of the form:

$$N=U.D.V \tag{8}$$

in which U and V are integer unimodular matrices (i.e. matrices for which the following equation applies: det(U)=det(V)=1, and D is an integer diagonal matrix of the form:

$$D=\begin{bmatrix} d_1 & 0 \\ 0 & d_2 \end{bmatrix} \tag{9}$$

in which $d_1$ is a divisor of $d_2$.

b) Substitution of equation (8) in equation (3) to yield:

$$X(k)=\sum_{n\epsilon L_{I/N}} x(n)x\exp(-jk^T[V^{-1}(2\pi D^{-1})U^{-1}]n) \tag{10}$$

with $k\epsilon L_{I/N}{}^T$.

Defining $\hat{n}=U^{-1}.n$ (11) and $\hat{k}:(V^{-1})^T.k$ (12), equation (10) can be written as follows:

$$X((V^{-1})^T\hat{k})=\sum_{n\epsilon L_{I/N}} x(U^{-1}\hat{n})x\exp(-j\pi\hat{k}^T D^{-1}\hat{n}) \tag{13}$$

with $\hat{k}\epsilon L_{I/N}{}^T$

As the matrix D is a diagonal matrix, equation (13) describes a conventional rectangular "DFT" with a row/column decomposition.

Note that the new variables introduced (see (11) and (12)) are isomorphic with the variables n and k, respectively. Moreover, they presuppose only a rearrangement of the input and output data that does not imply any additional computation. Note finally that, the parameters of a particular problem being fixed, meaning the geometry of the antenna and of the beams, the rearrangement just mentioned does not impact on the resultant hardware. It is merely necessary to know how to associate the "DFT" inputs with the radiating elements and the "DFT" outputs with the beams, which can be deduced from equation (11).

With a) and b), a first objective of the invention yielding an efficient hardware layout, i.e. the row/column decomposition, is obtained.

The objective of a breakdown into large modular blocks (referred to above as "macroblocks") is also achieved. These blocks are repeated in the architecture.

It is also interesting to note that all the "DFT" rows are identical, as are the columns. It is therefore necessary to determine only one of these blocks.

Furthermore, the large two-dimensional "DFT" has been reduced to two smaller, "DFT". Thus the first step for computing a "FFT" has been realized.

To achieve the other objectives of the invention it is necessary to carry out. further steps. Each of the two one-dimensional "DFT" will now be decomposed into a set of small modular blocks, compatible with the limitations of the integration technologies currently used for this type of application. These blocks can then be used many times in the beam forming network of the invention.

To achieve this it is necessary, independently, to work further on the rows and the columns of the one-dimensional "DFT" and to make use of the "FFT" algorithm well known for one-dimensional "DFT", i.e. the "radix" algorithm (radix-2, radix-3, radix-4, etc), decomposition into primary factors, etc. The selection of the algorithm depends on the size of the one-dimensional "DFT". A review of these algorithms can be found in the following articles:

Russel M. Mersereau: "The Processing of Hexagonally Sampled Two-Dimensional Signal", published in "Proceedings of the 1EEE", vol. 67, No. 6, June 1979, pages 930–949;

Russel M. Mersereau et al.: "The Processing of Periodically sampled Multidimensional Signals", published in "IEEE Transactions on ASSP", vol. 31, February 1983, pages 188–194; and Abderrezac Guessoum et al.: "Fast Algorithms for the Multidimensional Discrete Fourier Transform" published in "IEEE Transactions on ASSP", vol. 34, August 1986, pages 937–943.

Although the previous decomposition can be efficient in practice (when the size of the network and the number of beams can be adjusted to obtain well conditioned numbers), an alternative procedure which further reduces the number of phase-shifters can be used if det(D) can be expressed as the product of two numbers (p and q) which are mutually prime. In this case, the decomposition into smaller "DFT" can be done directly in the case of two dimensions and not independently in the case of one dimension. This situation can be regarded as an extension of the theory of the decomposition of the one-dimensional "FFT" into prime factors, known as the Matrix Prime Factor Algorithm ("MPFA").

These two approaches to decomposition yield a hardware architecture that meets all the requirements that apply to the invention, i.e., in addition to those already summarized, the following requirements:

The sets of large one-dimensional "DFT" are reduced to small "DFT" blocks, repeated many times throughout the architecture;

The phase-shifters in the intermediate stages between rows and columns are no longer needed; the number of phase-shifters is thus reduced.

Generally, with the parameters that it is usual to consider in a satellite communication application, the large two-dimensional "FFT" will comprise a layer of simple (third or fourth order) one-dimensional "DFT" for the row "DFT" and at most two layers of small one-dimensional "DFT" for the column one-dimensional "DFT". Thus there are three layers in total.

The hardware architecture of beam forming networks in accordance with the invention will now be described.

To give a more concrete idea of the invention, two numerical examples will be considered: a first example concerning moderate size beam forming network architecture, specifically a 27×27 hexagonal beam forming network, and a second example concerning a more complex beam forming network, specifically a 48×48 beam forming network.

In the procedure just outlined, the first step is to determine the regions of the support, i.e. of the antenna. Assuming that $N_1=N_2=3$, the total number of radiating elements will be equal to $2\times N_1\times N_2+N_2^2$, i.e. 27 radiating elements and 27 beams. The region of the support is shown in FIG. 4; elements $E1_1$ through $E1_{27}$.

The matrix N is determined: from equation (1), the matrix N becomes:

$$N=\begin{bmatrix} 6 & 3 \\ 3 & 6 \end{bmatrix} \tag{14}$$

The values of the elements [n] of $L_{I/N}$ and the elements [k] of $L_{I/N}{}^T$ are determined:

The selection is non-unique since, as mentioned already, there is an infinite number of representations of each class. The following set may be chosen:

$$[n] = \begin{Bmatrix} n_1 = (0,0) & n_2 = (1,0) & n_3 = (2,0) \\ n_4 = (0,1) & n_5 = (1,1) & n_6 = (2,1) \\ n_7 = (0,2) & n_8 = (1,2) & n_9 = (2,2) \\ n_{10} = (0,3) & n_{11} = (1,3) & n_{12} = (2,3) \\ n_{13} = (0,4) & n_{14} = (1,4) & n_{15} = (2,4) \\ n_{16} = (0,5) & n_{17} = (1,5) & n_{18} = (2,5) \\ n_{19} = (0,6) & n_{20} = (1,6) & n_{21} = (2,6) \\ n_{22} = (0,7) & n_{23} = (1,7) & n_{24} = (2,7) \\ n_{25} = (0,8) & n_{26} = (1,8) & n_{27} = (2,8) \end{Bmatrix} \tag{15}$$

and $$[k] = \begin{Bmatrix} k_1 = (0,0) & k_2 = (1,0) & k_3 = (2,0) \\ k_4 = (0,1) & k_5 = (1,1) & k_6 = (2,1) \\ k_7 = (0,2) & k_8 = (1,2) & k_9 = (2,2) \\ k_{10} = (0,3) & k_{11} = (1,3) & k_{12} = (2,3) \\ k_{13} = (0,4) & k_{14} = (1,4) & k_{15} = (2,4) \\ k_{16} = (0,5) & k_{17} = (1,5) & k_{18} = (2,5) \\ k_{19} = (0,6) & k_{20} = (1,6) & k_{21} = (2,6) \\ k_{22} = (0,7) & k_{23} = (1,7) & k_{24} = (2,7) \\ k_{25} = (0,8) & k_{26} = (1,8) & k_{27} = (2,8) \end{Bmatrix} \tag{16}$$

Note that, since N is symmetrical, [n] and [k] have the same sets of values.

The values of x(n) are then determined and linked to the elements $E1_i$ of the antenna (see FIG. 4):

$$\begin{array}{ll} x(n_1) = x(0,0) = \text{element } 1 & x(n_2) = x(1,0) = \text{element } 2 \\ x(n_3) = x(2,0) = \text{element } 3 & x(n_4) = x(0,1) = \text{element } 4 \\ x(n_5) = x(1,1) = \text{element } 5 & x(n_6) = x(2,1) = \text{element } 6 \\ x(n_7) = x(0,2) = \text{element } 8 & x(n_8) = x(1,2) = \text{element } 9 \\ x(n_9) = x(2,2) = \text{element } 10 & x(n_{10}) = x(0,3) = \text{element } 13 \\ x(n_{11}) = x(1,3) = \text{element } 14 & x(n_{12}) = x(2,3) = \text{element } 15 \\ x(n_{13}) = x(0,4) = \text{element } 7 & x(n_{14}) = x(1,4) = \text{element } 19 \\ x(n_{15}) = x(2,4) = \text{element } 20 & x(n_{16}) = x(0,5) = \text{element } 11 \\ x(n_{17}) = x(1,5) = \text{element } 12 & x(n_{18}) = x(2,5) = \text{element } 24 \\ x(n_{19}) = x(0,6) = \text{element } 16 & x(n_{20}) = x(1,6) = \text{element } 17 \\ x(n_{21}) = x(2,6) = \text{element } 18 & x(n_{22}) = x(0,7) = \text{element } 21 \\ x(n_{23}) = x(1,7) = \text{element } 22 & x(n_{24}) = x(2,7) = \text{element } 23 \\ x(n_{25}) = x(0,8) = \text{element } 25 & x(n_{26}) = x(1,8) = \text{element } 26 \\ x(n_{27}) = x(2,8) = \text{element } 27 & \end{array} \tag{17}$$

The "FFT" architecture is deduced from this:

a) Decomposition of the matrix N into its Smith normal form:

$$N = U.D.V = \begin{bmatrix} 2 & 1 \\ 1 & 0 \end{bmatrix} \begin{bmatrix} 3 & 0 \\ 9 & 0 \end{bmatrix} \begin{bmatrix} 1 & 2 \\ 0 & -1 \end{bmatrix} \tag{18}$$

b) Rewriting of the "DFT" in the form of a rectangular "DFT":

$$X((V^{-1})^T\hat{k}) = \sum_{\hat{n}\in L_{I/D}} x(U^{-1}\hat{n}) \cdot \exp(-j2\pi\hat{k}^T D^{-1}\hat{n}) \tag{19}$$

-continued with $\hat{k}\epsilon L_{I/DT}$ and $$D^{-1} = \begin{bmatrix} 1/3 & 0 \\ 0 & 1/9 \end{bmatrix} \tag{20}$$

$$\hat{n} = U^{-1} \cdot n = \begin{bmatrix} 0 & 1 \\ 1 & -2 \end{bmatrix} \cdot n \tag{21}$$

$$\hat{k} = V^{-1} \cdot k = \begin{bmatrix} 1 & 2 \\ 0 & -1 \end{bmatrix} \cdot k$$

Equation (21) determines the input and output rearrangements.

The one-dimensional "FFT" algorithm is then used for the row and column one-dimensional "DFT":

a) The row one dimensional "DFT" is a three-point "DFT"and is therefore reduced to its minimal expression.

b) The column one-dimensional "DFT" is a nine-point "DFT". it is therefore possible to use the radix-3 row/column decomposition algorithm.

Equation (19) can be rewritten in the following form:

$$X(k_1, k_2) = \sum_{n_2=0}^{8} \left[ \sum_{n_1=0}^{2} x(n_1, n_2) \exp\left( -j\frac{2\pi}{3} k_1 \cdot n_1 \right) \right] \cdot \exp\left( -j\frac{2\pi}{9} k_2 \cdot n_2 \right) \tag{22}$$

in which:

$$\hat{n} = (\hat{n}(1), \hat{n}(2) = (n_1, n_2) \tag{23}$$

$$\hat{k} = (\hat{k}(1), \hat{k}(2) = (k_1, k_2) \tag{24}$$

$C(n_2, K_1)$ can be defined as follows:

$$C(n_2, k_1) = \sum_{n_1=0}^{2} x(n_1, n_2) \exp\left( -j\frac{2\pi}{3} k_1 \cdot n_1 \right) \tag{25}$$

Substituting (25) in (22):

$$X(k_1, k_2) = \sum_{n_1=0}^{2} C(n_2, k_1) \exp\left( -j\frac{2\pi}{9} k_2 \cdot n_2 \right) \tag{26}$$

The following changes of variable are then effected:

$$n_2 = 3p + q \text{ with } p\epsilon(0,1,2) \text{ and } q\epsilon(0,1,2) \; k_2 = 3r + s \text{ with } r\epsilon(0,1,2) \text{ and } s\epsilon(0,1,2) \tag{27}$$

Equation (28) is then obtained:

$$X(k_j, 3r + s) = \sum_{q=0}^{2} \left[ \left[ \sum_{p=0}^{2} C(3p + q, k_1) \cdot e^{\left(-j\frac{2\pi}{3} s \cdot p\right)} \right] \cdot e^{\left(-j\frac{2\pi}{9} s \cdot q\right)} \right] \cdot e^{\left(-j\frac{2\pi}{3} r \cdot q\right)} \tag{28}$$

Defining:

$$D(q, k_1, s) = \sum_{p=0}^{2} C(3p + q, k_1) \exp\left( -j\frac{2\pi}{3} s \cdot p \right) \tag{29}$$

and:

-continued $$E(q, k_1, s) = D(q, k_1, s)\exp\left(-j\frac{2\pi}{9}\, s \cdot q\right) \tag{30}$$

and substituting (30) in (28), there is finally obtained:

$$X(k_1, 3r+s) = \sum_{q=0}^{2} E(q, k_1, s)\exp\left(-j\frac{2\pi}{3}\, s \cdot q\right) \tag{31}$$

or its equivalent:

$$X(k_1, 3r+s) = \underbrace{\sum_{q=0}^{2}\left[\left[\left[\overbrace{\sum_{p=0}^{2}\left[\underbrace{\sum_{nj=0}^{2} x(n_1, 3p+q)\cdot e^{-j\frac{2\pi}{3}k_1\cdot n_1}}_{C(3r+s,\, n_1)}\right]\cdot e^{\left(-j\frac{2\pi}{9}s\cdot p\right)}}^{D(q,\, k_j,\, n)}\right]\cdot e^{\left(-j\frac{2\pi}{9}s\cdot q\right)}\right]\cdot e^{\left(-j\frac{2\pi}{3}r\cdot q\right)}\right]}_{E(q,\, k_1,\, s)} \tag{32}$$

The inverse transform can be obtained simply by conjugating the exponentials, normalizing by the determinant of D and changing the variables:

$$X(n_j, 3p+q) = \frac{1}{|det(D)|}\underbrace{\sum_{s=0}^{2}\left[\left[\left[\overbrace{\sum_{r=0}^{2}\left[\underbrace{\sum_{k_1=0}^{2} X(k_1, 3r+s)\cdot e^{-j\frac{2\pi}{3}k_1\cdot nj}}_{C(3r+s,\, n_1)}\right]\cdot e^{\left(j\frac{2\pi}{3}q\cdot r\right)}}^{D(s,\, n_1,\, q)}\right]\cdot e^{\left(j\frac{2\pi}{9}q\cdot s\right)}\right]\cdot e^{\left(j\frac{2\pi}{3}p\cdot s\right)}\right]}_{R(s,\, n_1,\, q)} \tag{33}$$

The architecture of the beam forming network can be determined such that it satisfies equations (32) and (33), i.e. so that the transforms "DFT" and "IDFT" are done.

Figure 5:
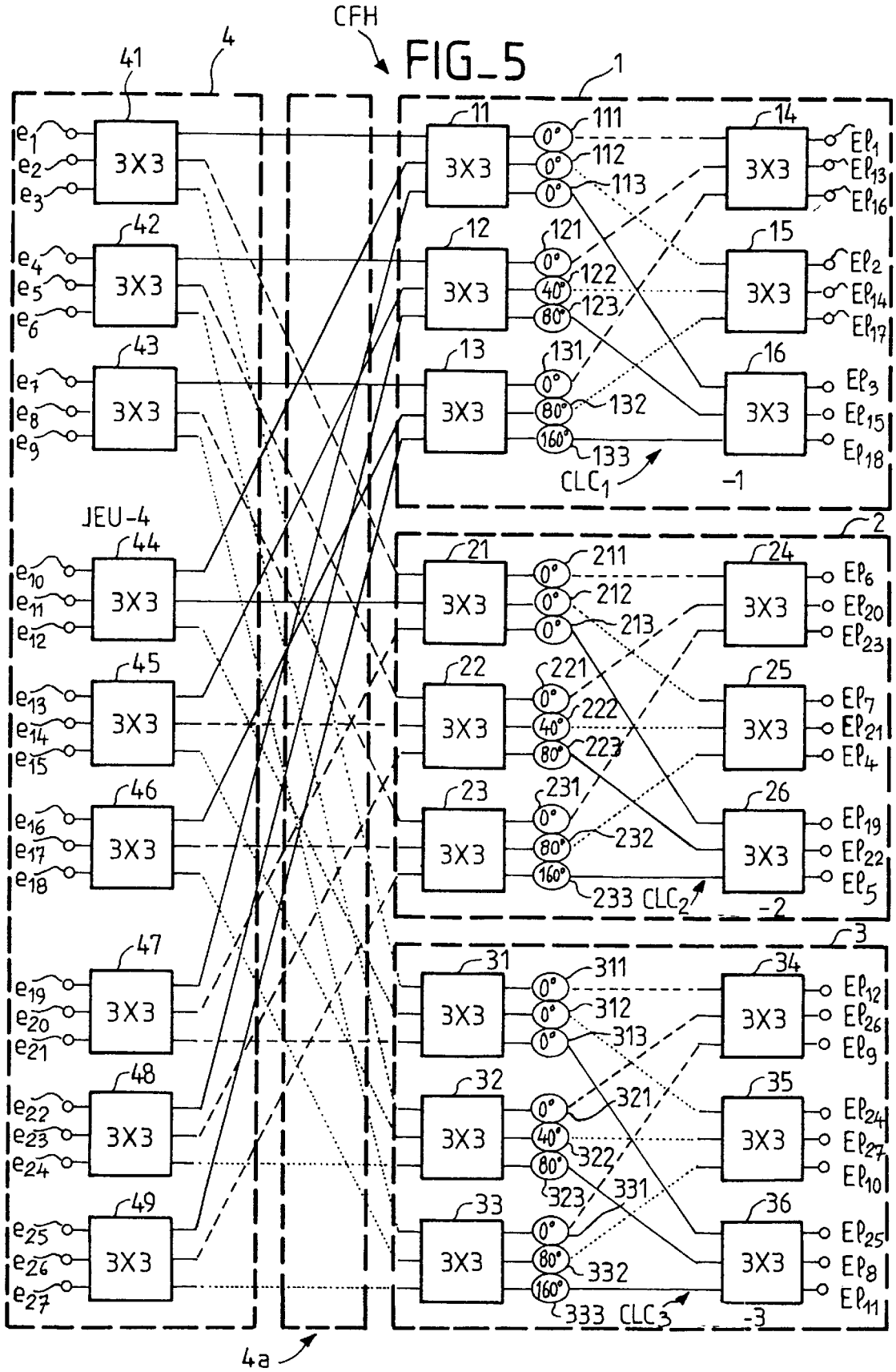
FIG. 5 is a diagram showing the functional architecture of a 27×27 hexagonal beam forming network of the invention.

FIG. 5 shows the architecture of a 27×27 hexagonal beam forming network CFH of the invention.

The rearrangement of the output elements is indicated by the references $E1_1$ through $E1_{27}$. These references correspond to those of the radiating elements in FIG. 4. This rearrangement is derived from equation (21)

As shown clearly in FIG. 5, the hexagonal beam forming network CFH of the invention comprises only two main circuit layers. Further, it uses only one, very simple sort of cell, in this instance circuits effecting a three-point one-dimensional "DFT".

To be more precise, the hexagonal beam forming network CFH comprises four sets of colls: 1 through 4, the set 4 constituting one of the circuit layers.

This layer comprises nine identical cells or modules 41 through 47 effecting a three-point one-dimensional "DFT". A module of this kind will be described below with reference to FIG. 6. The number of inputs of these cells $e_1$ through $e_{27}$, from top to bottom in FIG. 5, is equal to the number of elements $E1_i$.

The second circuit layer comprises three sets 1 through 3. Each of these sets has nine inputs and nine outputs. Each set is made up of two rows of three unit cells each effecting a three-point "DFT". The two rows are linked by row/column connection routings incorporating phase-shifters: 111 through 133, 211 to 233 and 311 through 333, with the respective names $CLC_1$ through $CLC_3$, respectively, for sets 1 through 3. Each set has exactly the same topology. The three outputs of the first module, for example the module 11, are each connected to 0° phase-shifters: 111, 112 and 113. In other words, the output signals are not phase shifted. The three outputs of the second module, for example the module 12, are respectively connected to 0°, 40° and 80° phase-shifters: 121, 122 and 123. The three outputs of the third module, for example the module 13, are respectively connected to 0°, 80° and 160° phase-shifters: 131, 132 and 133. The outputs of the first phase-shifters of each set, for example 111, 122 and 131, are connected to one of the three inputs (from top to bottom in FIG. 5) of the first module of the second row, for example module 14. The outputs of the second phase-shifters of each set, for example 112, 122 and 132, are connected to one of the three inputs of the second module of the second row, for example the module 15. The outputs of the third phase-shifters of each set, for example 113, 123 and 133, are connected to one of the three inputs of the third module of the second row, for example the module 16.

The outputs of the cells 14 through 16, 24 through 26 and 34 through 36 of the second row of the sets 1 through 3 are connected to the radiating elements in the following order, in accordance with the previously mentioned rearrangement: $E1_1$, $E1_{13}$, $E1_{16}$, $E1_2$, $E1_{14}$, $E1_{17}$, $E1_3$, $E1_{35}$, $E1_{18}$, $E1_6$, $E1_{20}$, $E1_{23}$, $E1_7$, $E1_{21}$, $E1_4$, $E1_{39}$, $E1_{22}$, $E1_5$, $E1_{12}$, $E1_{26}$, $E1_9$, $E1_{24}$, $E1_{27}$, $E1_{10}$, $E1_{25}$, $E_8$ and $E1_{11}$ (from top to bottom in the figure).

The first outputs of the first three cells 41 through 43 of the set 4 are connected to the first inputs of the cells 11 through 13 of the first row of the set 1. Similarly, the first outputs of the next three cells 44 through 46 are connected to the second inputs of the three cells 11 through 13 and the first outputs of the last three cells 47 through 49 are connected to the third inputs of the three cells 11 through 13.

This interconnection scheme is repeated for the second outputs of all the cells of the first set that are connected to the second inputs of the sets of the second layer. The same applies to the third outputs that are connected to one of the third inputs of the cells of the second circuit layer.

This arrangement of row/column connections carries the general reference 4*a*.

The architecture of the hexagonal beam forming network in accordance with the invention is therefore totally regular. Furthermore, it is much less complex than the architecture of an equivalent prior art hexagonal beam forming network as described, for example, in the previously mentioned article by Chadwick. The number of phase-shifters is reduced to the minimum, which is in accordance with one aim of the invention.

The architecture of the hexagonal beam forming network CFH just described lends itself to very easy integration of a matrix of radiofrequency switches. By incorporating this matrix directly into the architecture of the beam forming network a high degree of beam switching capability is obtained. To be more precise, the resultant architecture implements not only the functions corresponding to a hexagonal beam forming network but also those corresponding to a beam switch.

Figure 6:
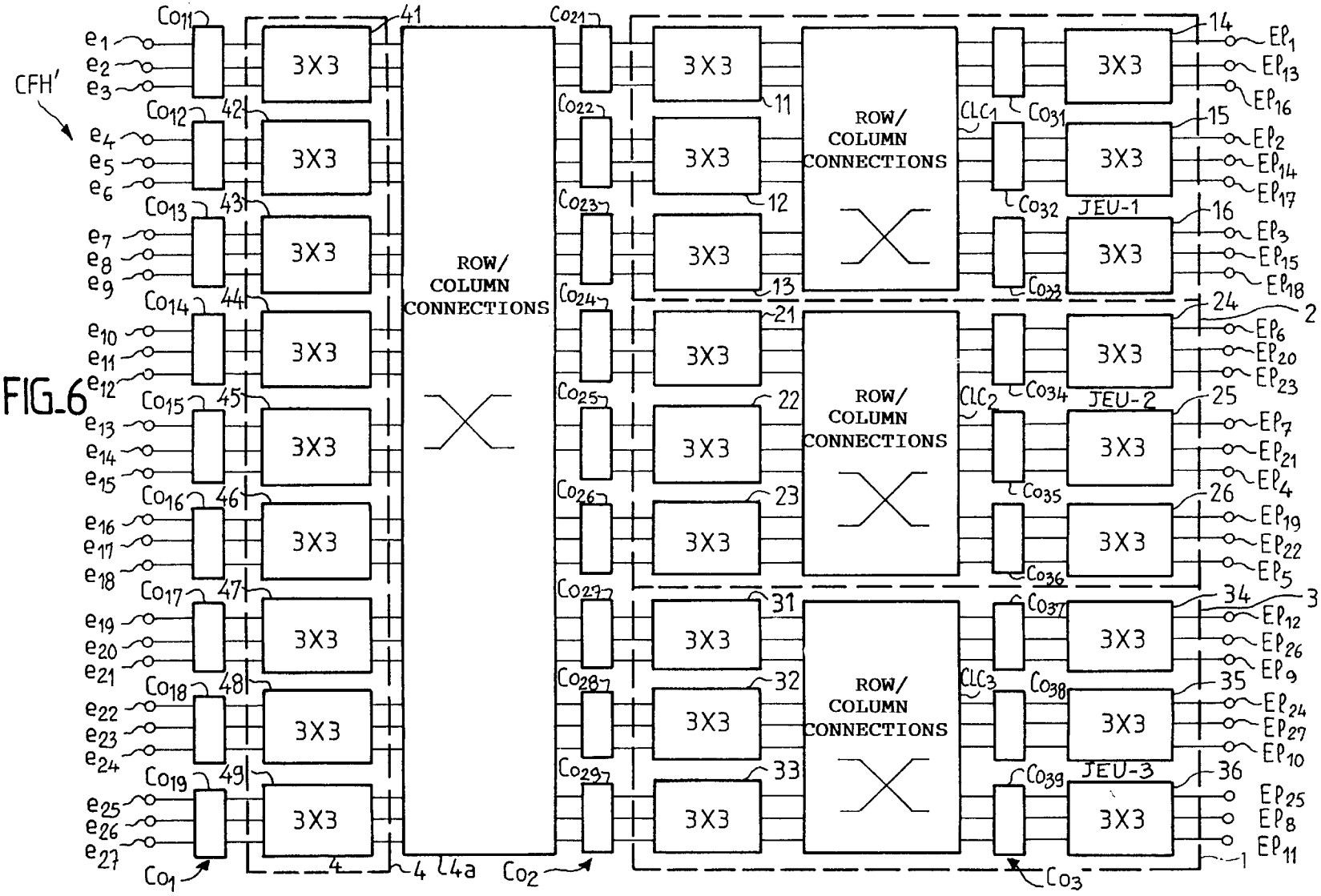
FIG. 6 is a diagram showing the functional architecture of a 27×27 hexagonal beam forming network of the invention incorporating switches.

FIG. 6 is a diagram showing an architecture of this kind in the specific example of a 27×27 hexagonal beam forming network CFH'. It repeats in its entirety the architecture of the beam forming network from FIG. 5 and there is no point is describing this again.

The main difference is the addition of three layers of switches $Co_1$ through $Co_3$. Each layer includes nine 3×3 switch matrices: $Co_{11}$ through $Co_{19}$ for the first layer $Co_1$; $Co_{21}$ through $Co_{29}$ for the second layer $Co_2$; $Co_{31}$ through $Co_{39}$ for the third layer $Co_3$.

The first layer $Co_1$ is interleaved between the inputs $e_1$ through $e_{27}$ and the inputs of the 3×3 cells 41 through 49 of the circuits 4.

The second layer $Co_2$ is interleaved between the outputs of the set of row/column connections 4*a* and the inputs of the 3×3 cells 41 through 49.

Finally, the third layer $Co_3$ is interleaved between the outputs of the three sets of row/column connections $CLC_1$ through $CLC_3$ and the inputs of the 3×3 cells 41 through 49.

Note that the architecture of the beam forming network CFH' is still entirely symmetrical.

By initializing all the twenty-seven 3×3 switch matrices to an appropriate state, it is in theory possible to obtain $6^{27}$ permutations of the real beams in space, corresponding to each beam input port.

In reality, this technique does not allow implementation of all the above permutations. The number of permutations is nevertheless extremely high. Experience indicates that it is sufficient for most applications.

This solution should be compared with the conventional solution which, to obtain the same result, would use a complete 27×27 switch matrix cascaded with a beam forming network.

There are various architectures known in themselves for implementing the radiofrequency switch function (crossbar, reconfigurable circuits, power splitter-mixer circuits, etc). As a general rule, the circuit layouts are restricted by the insulation required between ports, which decreases in proportion to the size of the switch matrix and/or in proportion to the associated insertion losses.

If the architecture of the invention is used, allowing the incorporation of the switching function into the beam forming function, good insulation can be achieved: each signal propagates through only switching circuits of a 3×3 matrix, in the case of a 27×27 hexagonal beam forming network. The increase in the insertion losses is negligible.

Figure 7:
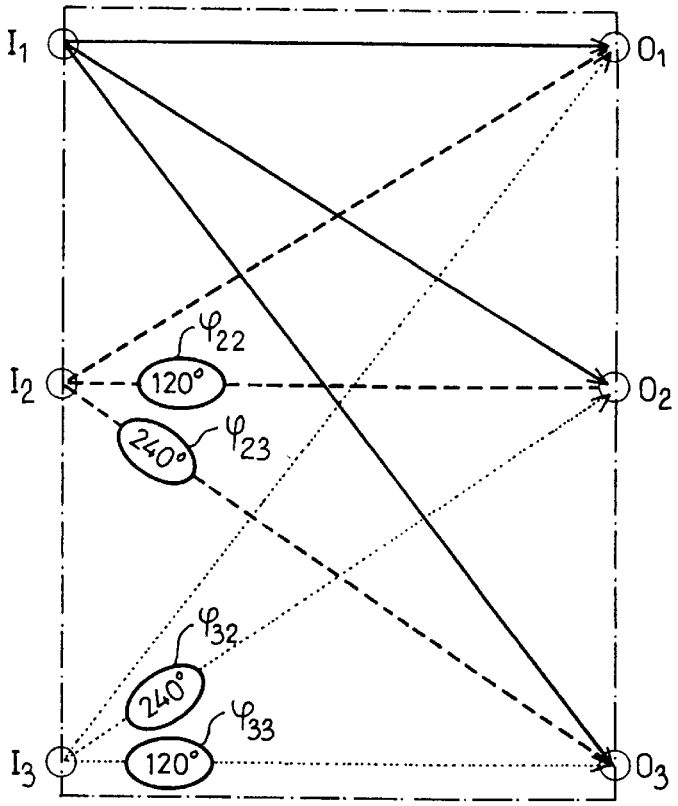
FIGS. 7 and 8 show the functional architecture and the topology of the circuits of a 3×3 unit cell utilized repetitively to implement the beam forming network of FIG. 5.

FIG. 7 is a highly schematic representation of the functional architecture of a circuit effecting a three-point one-dimensional "DFT" on three input signals $l_1$ through $I_3$. There are three output signals $O_1$ through $O_3$. The cell described is the cell 11, for example, it being understood that all the cells are identical. This is a standard circuit, well known to the person skilled in the art and therefore requires no further description. Suffice to say that the connections between the inputs and the signal output $O_3$ do not include phase-shifters. Likewise between $I_1$ and $O_1$. The direct connections $l_2$–$O_2$ and $I_3O_3$ include a respective 120° phase-shifter $\phi_{22}$ and $\phi_{33}$. The crossed connections $l_2$–$O_3$ and $I_3$–$O_2$ include a respective 240° phase-shifter $\phi_{23}$ and $\phi_{32}$.

Figure 8:
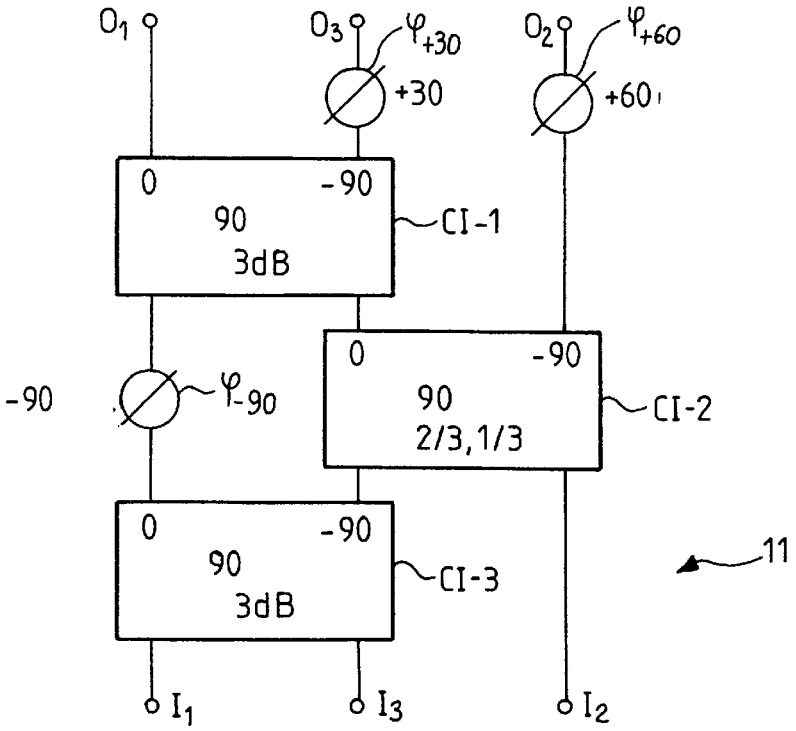

The unit cells 11 through 49 (FIG. 5) can be fabricated using miniaturization technologies such as the gallium arsenide monolithic microwave integrated circuit ("GaAs MMlC") technology. Depending on the dimensions of the unit cell, one or more "MMICs" will be needed to integrate the cell. In the example described, the unit cell can be implemented as shown in FIG. 8. The cell 11, the functional architecture of which is shown in FIG. 7, is implemented by means of radiofrequency "MMICs" that integrate the circuits CI-1 through CI-3 each forming a 90°/3 dB hybrid technology sub-cell each having two inputs and two outputs, one of the outputs being phase-shifted by 90°. The sub-cell C1-2 effects an asymmetric splitting of the received electrical power, in the sense that ⅔ of the power is transmitted to the port "0" and ⅓ of the power to the port "−90". The number of "MMICs" depends on the technology. A solution based on a single IC is feasible if the total size of the IC remains compatible with the integration technologies used in the field. The phase-shifting is obtained by means of capacitors and inductors with lumped constants in the "L" or "S" band. The additional phase-shifters $\phi_{-90}$, $\phi_{+30}$ and $\phi_{+60}$ provide the 120° and 240° phase-shifts of FIG. 6. The phase-shifters 111 through 333 in FIG. 5 could also be included in the "MMIC(s)".

The "MMIC(s)" are advantageously included in a single microwave module.

It is evident that the architecture described, in allowing the use of the "MMIC" technology, is highly advantageous from more than one point of view.

An electrical behavior that is very similar from one cell to another can be expected, both with regard to the phase-shift and with regard to the amplitude of the signals produced. Manufacturing tolerances and the associated problems are therefore minimized.

Similarly, because of the very simple nature of "MMlCs", in passive circuits based on circuits including only capacitors and inductors, a very high fabrication yield can be obtained, resulting in low costs due to this high yield.

Figure 9:
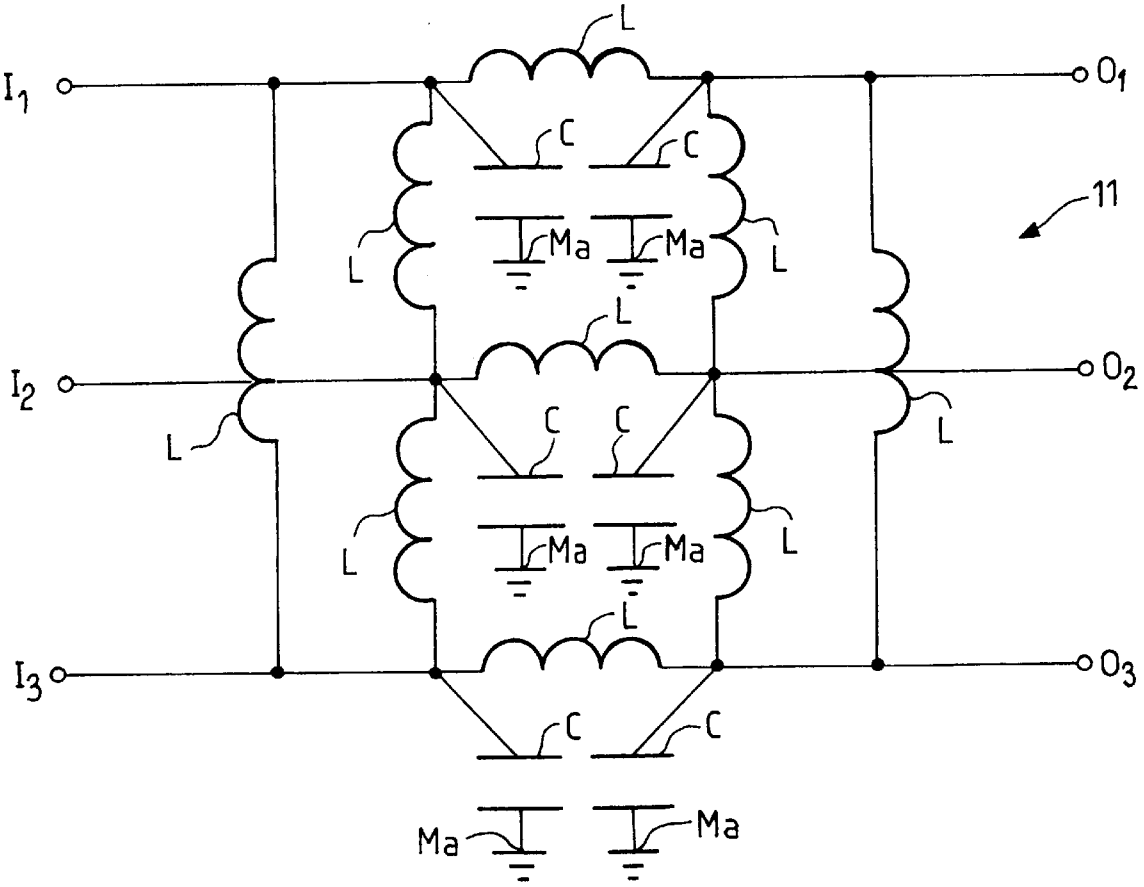
FIG. 9 shows the topology of the circuits of a second embodiment of a 3×3 unit cell used repetitively to implement the beam forming network of FIG. 5 or FIG. 6.

It is still possible to improve the topology of the 3×3 unit cells. FIG. 9 is a diagram showing the topology of a 3×3 cell in one preferred embodiment of the invention.

As previously, the cell described is the cell 11, it being understood that all the cells are identical.

The cell has three inputs $I_1$ through $I_3$ and three outputs $O_1$ through $O_3$.

As previously, capacitors and inductors with lumped constants in the "L" or "S" band are used. The inductors are all marked "L" and the capacitors are all marked "C", as the components of each kind are all identical. This constitutes a first simplification.

Further, it is evident from FIG. 9 that the topology of the circuit is extremely simple.

The layout rules are as follows:

Each input $I_1$ through $I_3$ is connected to the other two via an inductor L;

Each output $O_1$ through $O_3$ is connected to the other two via an inductor L;

Each input $I_1$ through $I_3$ is connected to a respective output $O_1$ through $O_3$ via an inductor L (to be more precise, to the output with the same number);

Finally, each input $I_1$ through $I_3$ or output $O_1$ through $O_3$ is connected to ground potential $M_a$ via a capacitor C.

The cell is extremely symmetrical and therefore easy to fabricate.

This 3×3 cell configuration allows integration on a single "MMIC", at least. In fact it is possible to integrate more than one cell on a single larger "MM1C", which is not possible for cells as shown in FIG. 8.

The specific advantages of this topology arc as follows:

The required function is obtained with a smaller number of inductors and capacitors;

All the capacitors have the same value for a given type of cell, which allows the circuits of the beam forming network to be adjusted in the manner described below.

Since all the "MMlCs" used in a given beam-forming network come from the same wafer, all of the capacitors will have values with very similar errors compared to the computed theoretical nominal values. this error can naturally generate phase and amplitude errors, and these must be compensated.

This problem can be solved easily if each of the capacitors C is replaced by a lower value fixed capacitor C' in parallel with a MESFET type transistor which functions as a variable capacitor. To vary the capacitance the gate voltage is modified.

Figure 10:
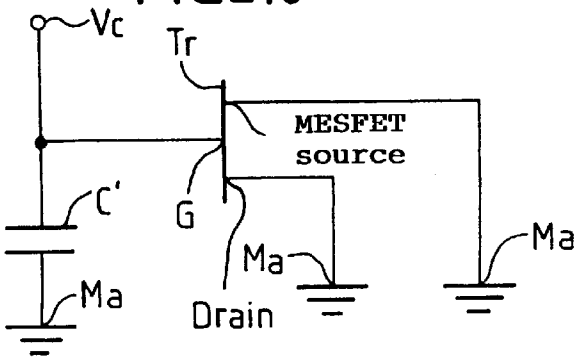
FIG. 10 shows a variant of this second embodiment.

FIG. 10 shows an arrangement of this kind. The capacitor C' is in parallel with a MESFET type transistor $T_r$ the source and the drain of which are at the ground potential $M_a$. This particular configuration is naturally adopted for all the capacitors of a 3×3 cell.

Since all the capacitors used in all the 3×3 unit cells in the hexagonal beam forming network as a whole have the same value, it is sufficient to apply the same control voltage $V_c$ to all the gates to adjust all the capacitors of the same type of cell to the required nominal capacitance value. As mentioned above, all the errors due to manufacturing deficiencies are very similar. It follows that the phase and amplitude errors can be minimized in a very simple manner.

This fact alone allows a very significant increase in the maximal usable dimensions of the beam forming network.

The architecture of a more complex hexagonal beam forming network will now be described. To make the example more concrete, a 48×48 beam forming network is considered.

The steps of the procedure are the same as for the beam forming network previously described.

In this network $N_1-N_2=4$, i.e. in total (see above) $3\times N_1^2=3\times N_2^2=48$ elements.

The periodicity of the N matrix is determined (see (1)):

$$N=\begin{bmatrix}8 & 4\\ 4 & 8\end{bmatrix} \tag{34}$$

The matrix N is then decomposed into its Smith normal form:

$$N=U.D.V=\begin{bmatrix}2 & 1\\ 1 & 0\end{bmatrix}\begin{bmatrix}4 & 0\\ 0 & 12\end{bmatrix}\begin{bmatrix}1 & 2\\ 0 & -1\end{bmatrix} \tag{35}$$

Note that, in this case, det(D)÷48=3×16, i.e. it can be written in the form of the product of two mutually prime numbers (p=3, q=16). As already mentioned, this makes it easier to decompose the "DFT" using the Matrix Prime Factor Algorithm ("MPFA"). The algorithm is as follows:

$$D=D_1\cdot D_2=\begin{bmatrix}1 & 0\\ 0 & 3\end{bmatrix}\begin{bmatrix}4 & 0\\ 0 & 4\end{bmatrix} \tag{36}$$

The following matrices can be defined:

$$P_1=U.D_1 \tag{37}$$

$$P_2=D_1.V_3 \tag{38}$$

$$Q_1=D_2.V_1 \tag{39}$$

$$Q_2=U.D_2 \tag{40}$$

and likewise the following equations:

$$n=D_2.U^{-1}.n_1+D_1.U^{-1}.n_2 \pmod N \tag{41}$$

$$k=V^T.D_2.(V^{-1}).k_1=V^T.D_1.(V^{-1}).k_2 \pmod{N^T} \tag{42}$$

in which $n_1\epsilon L_{I/Pl}$, $n_2\epsilon L_{I/Q2}$, $k_1\epsilon L_{I/(Q1)}T$, $k2\epsilon L_{I/(P2)}T$, $n\epsilon L_{I/N}$ and $k\epsilon j,_{I/N}T$.

New variables are introduced:

$$\hat{n}_1=U^{-1}.n_1 \pmod{D_1}$$

$$\hat{n}_2=U^{-1}.n_2 \pmod{D_2}$$

$$\hat{k}_1=D_2.V^{-1}.k_1 \pmod{D_1}$$

$$\hat{k}_2=D_1.V^{-1}.k_2 \pmod{D_2} \tag{43}$$

It is then a simple matter to rewrite the 48×48 two-dimensional "DFT" in the form:

$$X(\hat{k}_1,\hat{k}_2)=\sum_{\hat{n}_1}\sum_{\hat{n}_{21}} x(\hat{n}_1,\hat{n}_2)e^{(-j2\pi(\hat{k}_j)^T\begin{bmatrix}1/3 & 0\\ 0 & 1\end{bmatrix}\hat{n}_1)}\cdot e^{(-j2\pi(\hat{k}_2)^T\begin{bmatrix}1/4 & 0\\ 0 & 1/4\end{bmatrix}\hat{n}_2)} \tag{44}$$

From this it is possible to derive an architecture including a row/column breakdown of which the row part consists in a three-point one-dimensional "DFT" and each of the three column "DFT" consists in a 4×4 two-dimensional rectangular "FFT".

The initial two-dimensional "DFT" has been converted into a "FFT" algorithm requiring only the computation of a third order "DFT" for the first level and a fourth order "DFT" for the second and third levels. Only two types of one-dimensional "DFT" module are used (3×3 and 4×4).

Figure 11:
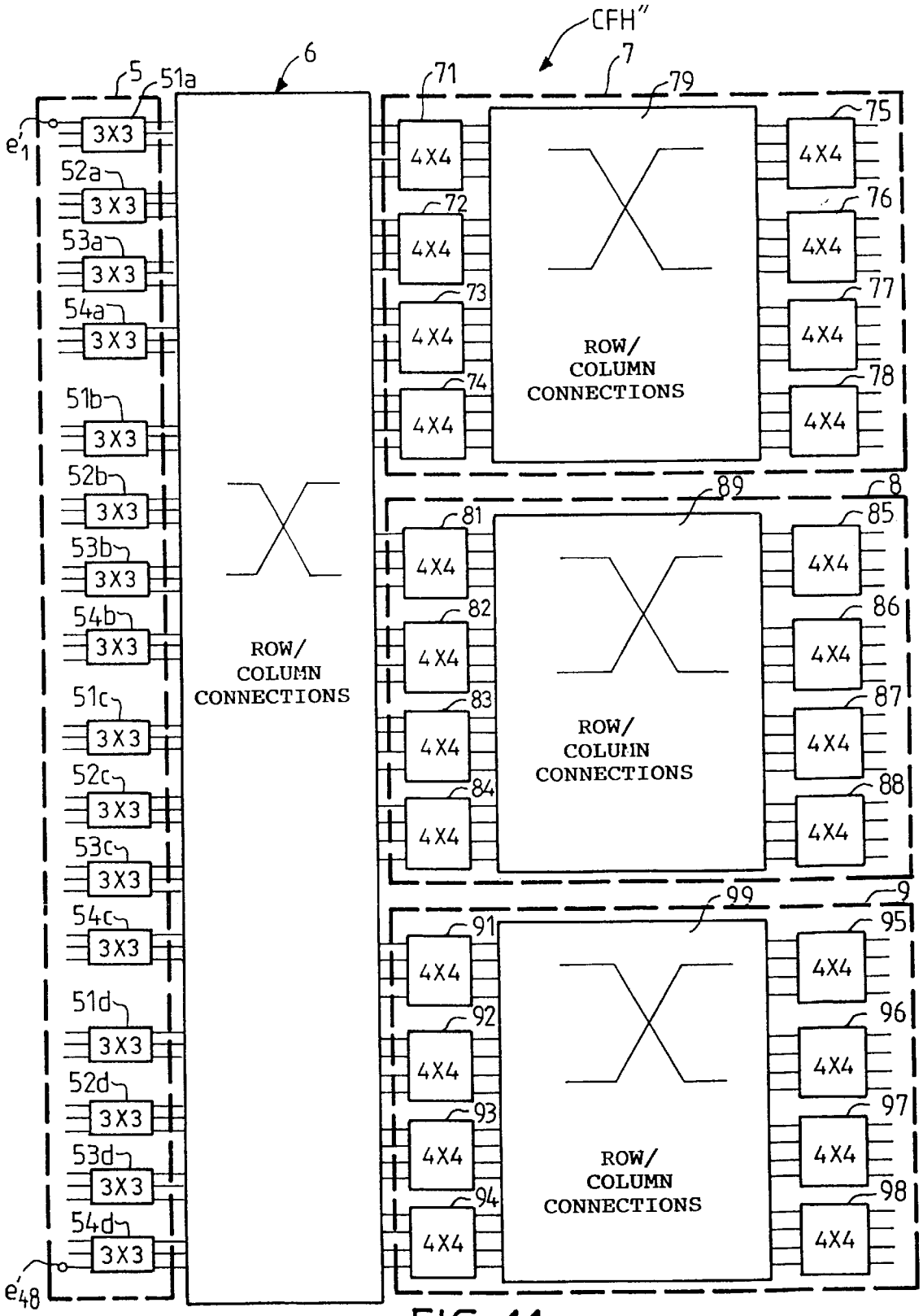
FIG. 11 is a diagram showing the functional architecture of a 48×48 hexagonal beam forming network of the invention.

FIG. 11 shows the architecture of a 48×48 hexagonal beam forming network "CFH" of the invention.

As previously, this architecture comprises two circuit layers comprising the set 5 (third order one-dimensional "DFT") for the first circuit layer and the sets 7 through 9 (4×4 rectangular FFT) for the second circuit layer.

The first set 5 is made up of sixteen identical 3×3 one-dimensional "DFT" 51*a*–54*a*, 51*b*–54*b*, 51*c*–54*c* and 51*d*–54*d* (from bottom to top in FIG. 11). Each cell has four inputs and four outputs. To avoid over complicating the figure only the end inputs $e'_1$ and $e'_{48}$ are marked.

The sets 7 through 9 are made up of identical 4×4 one-dimensional "DFT" cells disposed in two rows of four modules to form what are referred to above as the second and third levels. The first row comprises the cells 73 through 74, 81 through 84 and 91 through 94 for the sets 7, 8 and 9, respectively. The second row comprises the cells 75 through 78, 85 through 88 and 95 through 98 for the sets 7, 8 and 9, respectively. The two rows of cells are interconnected by row/column connection routings 79, 89 and 99 for the sets 7, 8 and 9, respectively. These routings are similar to (although slightly more complex than) those described in more detail with reference to the FIG. 5 architecture, relating to a 27×27 hexagonal beam forming network. They must satisfy equation (44). To give a more concrete idea of this, for the set 7 the first outputs of the modules 71 through 74 are each connected to an input of the cell 75, directly or via an additional phase-shifter (in a similar way to that of FIG. 5), the second outputs of the cells 71 through 74 are each connected to an input of the cell 76, and so on. The same naturally applies to the sets 8 and 9.

Similarly, the first and second circuit layers are interconnected by a connection routing 6 described in more detail below.

The 48 outputs of the cells 75 through 78, 85 through 88 and 95 through 98 are connected to the 48 radiating elements of the antenna (not shown in the figure).

The architecture of this second embodiment of the hexagonal beam forming network of the invention is thus totally regular. It is also much less complex than the architecture of an equivalent prior art hexagonal beam forming network, for example that described in the previously mentioned article bay Chadwick.

As in the 27×27 hexagonal beam forming network shown in FIG. 5, the "beam forming network" and "switch" functions could naturally be combined. In the resulting embodiment (not shown), all that is necessary is to add three layers of switching matrices, in a similar manner to that described with reference to FIG. 6, i.e. between the inputs and the 3×3 cells of the circuits 5, between the outputs of the set of row/column connections 6 and the 4×4 cells 71 through 94 and between the outputs of the sets of row/column connections 79 through 99 and the inputs of the 4×4 cells 75 through 98.

The matrices of the first layer have the same dimensions as the switching matrices described with reference to FIG. 6 since they must deliver signals to the three inputs of the 3×3 cells. On the other hand, and for a similar reason, the matrices of the second and third layers are 4×4 matrices, since they are associated with 4×4 cells.

For a $R \times N^2$ hexagonal beam forming network, the unit switching circuit matrices will generally have respective dimensions of R×R for the first layer and N×N for the second and third layers.

The 3×3 "DFT" modules (51*a* through 54*d*) can be implemented in exactly the same manner as the modules described with reference to FIGS. 7 and 8.

One embodiment of the 4×4 "DFT" modules will now be described with reference to FIGS. 12 and 13.

Figure 12:
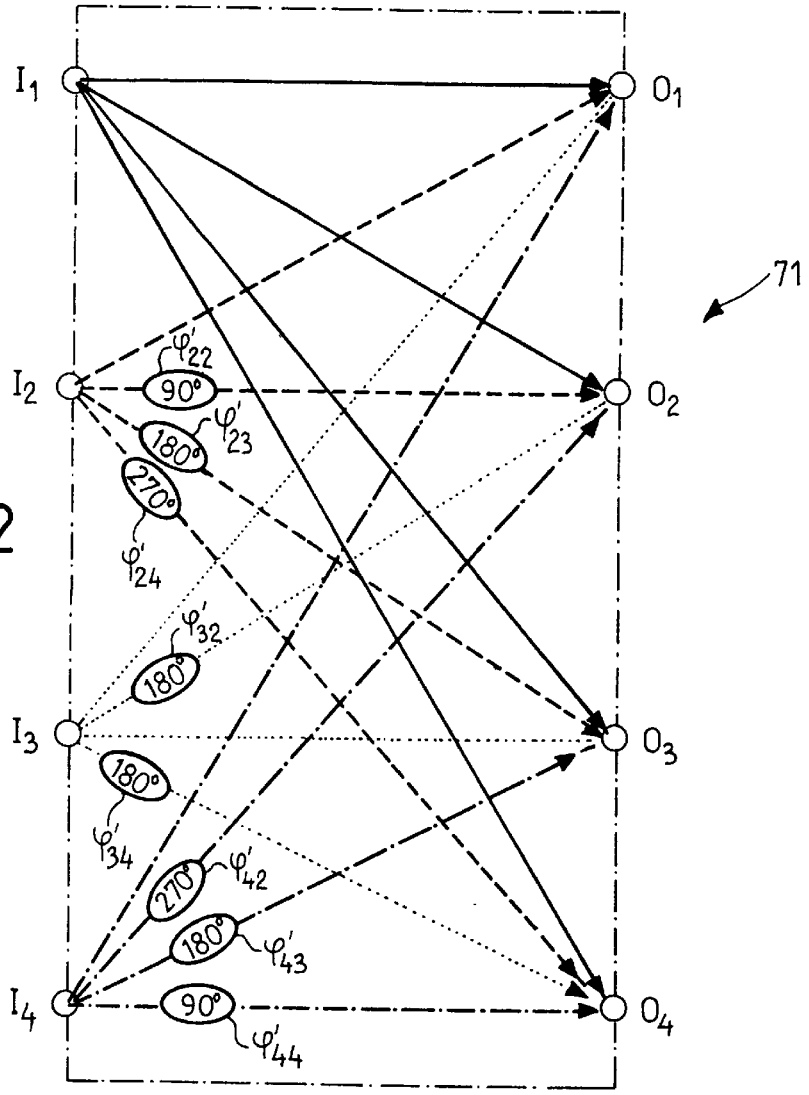
FIGS. 12 and 13 show the functional architecture and the topology of tile circuits of a 4×4 unit cell utilized repetitively to implement the beam forming network of FIG. 11.

FIG. 12 is a highly diagrammatic representation of a 4×4 one-dimensional "DFT" computation cell, for example the cell constituting the module 71; all of the modules 71 through 98 are, of course, identical.

The signal inputs are labelled $l_1$ through $I_4$ and the outputs $O_1$ through $O_4$. All the inputs are connected to all the outputs (trellis), some directly (i.e. without phase-shifting): $I_1$ to all the outputs, $I_2$ to $O_1$, $l_3$ to $O_1$ and $O_3$, and others via phase-shifters. $I_2$ is connected to $O_2$ via a 90° phase-shifter $\phi'_{22}$, to $O_3$ via a 180° phase-shifter $\phi'_{23}$ and to $O_4$ via a 270° phase-shifter $\phi'_{24}$. Similarly, $I_3$ is connected to $O_2$ via a 180° phase-shifter $\phi'_{32}$ and to $O_4$ by a 180° phase-shifter $\phi'_{34}$. Finally, $I_4$ is connected to $O_2$ by a 270° phase-shifter $\phi'_{42}$, to $O_3$ by a 180° phase-shifter $\phi'_{43}$ and to $O_4$ by a 90° phase-shifter $\phi'_{44}$.

Like the 3×3 cells, the 4×4 cells can be gallium arsenide (GaAs) "MMITC"·based modules.

Figure 13:
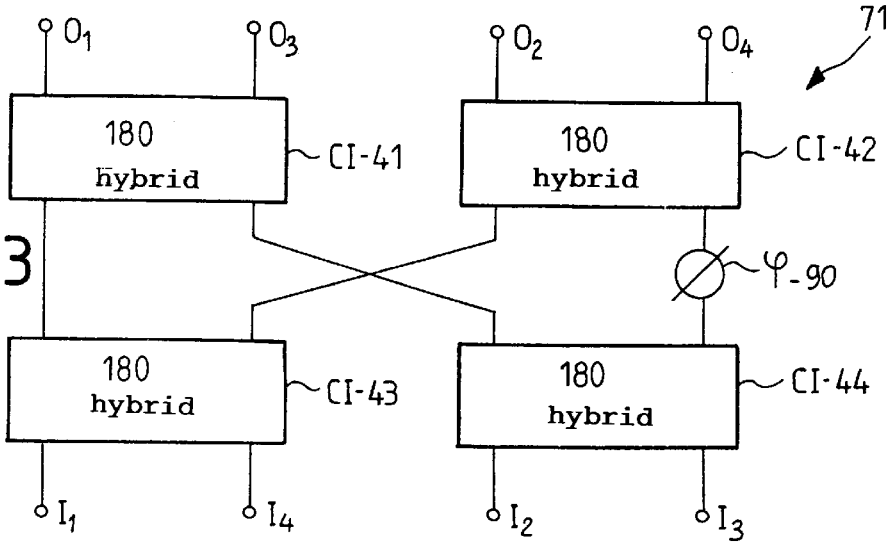

FIG. 13 shows one example of integration of the 4×4 "DFT" unit cell, for example the cell 71, the functional architecture of which has just been described. The module comprises one or more hybrid technology "MMIC(s)" integrating the circuits CI-41 through CI-44 with two inputs and two outputs, one of which is a direct output (with no phase-shifting, marked by an arrow in the figure) and one of which is phase-shifted by 180°. The circuit. Cl-43 receives at its input the input signals $l_1$ and $I_4$. In the context of the invention, the term "hybrid technology" means a circuit with four ports: two input ports and two output ports. These circuits have the peculiarity that a signal at a first input port. ($I_1$ for example for the circuit CI-43) is split into two signals with the same power and the same phase, passed to the two output ports, and that a signal at the second input port (marked by arrow in FIG. 13: $I_2$ for example for the circuit CI-43) is split into two signals with the same power and of opposite phase, passed to the two output ports. The circuit (CI-44 receives at its input the input signals $I_2$ and $I_3$. The direct output of the circuit CI-43 crosses over and is connected to the first input of the circuit CI-42 (on the lefthand side in the figure). The phase-shifted output of the circuit. CI-44 crosses over and is connected to the second input of the circuit CI-42 (on the righthand side in the figure). The direct output of the circuit CI-44 is connected via an additional phase-shifter $\phi_{-90}$ to the second input of the circuit CI-42 and the phase-shifted output of the circuit CI-41 is connected to the first input of the circuit CI-41. The first and second outputs of the circuit Cl-43 constitute the outputs $O_1$ and $O_3$, respectively. The first and second outputs of the circuit. CI-42 constitute the outputs $O_2$ and $O_4$, respectively.

Like the 3×3 cells, it is still possible to improve the topology of the 4×4 unit cells. FIG. 34 is a diagram showing the topology of a 4×4 cell in a preferred embodiment of the invention.

As previously, the cell described is the cell 73, it being understood that all the cells are identical.

The figure shows tho four inputs $I_1$ through $I_4$ and four outputs $O_1$ through $O_4$.

Also as previously, capacitor and inductors with lumped constants in the "L" or "S" band are used. The inductors are all marked "L" and the capacitors are all marked "C" as the components of the same kind are all identical.

The layout rules are similar to those previously stated:

Each input $I_1$ through $I_4$ is connected to the other two via an inductor L;

Each output $O_1$ through $O_4$ is connected to the other two via an inductor L;

Each input $I_1$ through $I_4$ is connected to a respective output $O_1$ through $O_4$ via an inductor L (to be more precise, to the output with the same number);

Finally, each input $I_1$ through $\mathbf{1}_4$ or output $O_1$ through $O_4$ is connected to ground potential $M_a$ via a capacitor C.

The cell is extremely symmetrical and therefore easy to fabricate.

This 4×4 cell configuration allows integration of the cells in a single "MMIC", at least, and it is in reality possible to integrate more than one cell into a single larger "MMIC".

The specific advantages of this topology are exactly the same as those stated for the 3×3 cells.

Accordingly, it is also the simple matter to compensate for the errors in the capacitance values actually obtained compared to the computed nominal values by replacing the capacitors with a fixed capacitor C' in parallel with a MESFET type transistor $T_r$.

Examples of physical layouts of hexagonal beam forming networks of the invention will now be described.

In examples of practical implementation, it is necessary to distinguish between three degrees of complexity of the circuits of the hexagonal beam forming network of the invention.

A distinction can be drawn between "normal", "large" and "very large" dimensions, the latter constituting the most general case.

This distinction relates essentially to the greater or lesser degree of integration allowed by the technologies employed.

Moreover, as has already been mentioned, if the preferred implementation of the unit cells is used (see FIGS. 10 and 14), the degree of integration can be very considerably increased.

Figure 15:
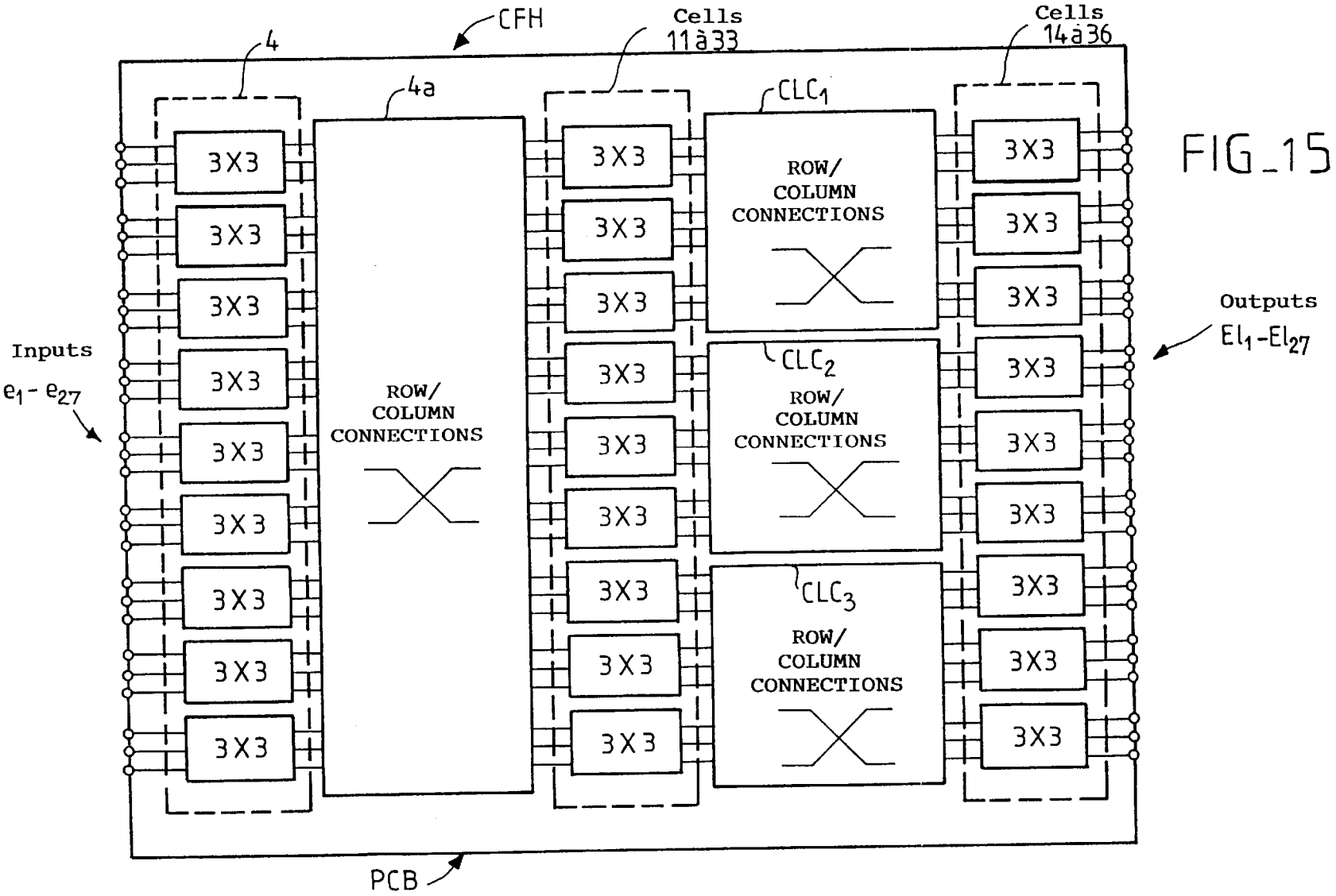
FIG. 15 is a diagram showing a first example of the physical layout of a beam forming network.

FIG. 15 shows a first example of layout for a beam forming network of low complexity ("normal" dimensions), for which the unit cells are integrated on single "MMICs". This example corresponds to a 27×27 hexagonal beam forming network CFH as shown in FIG. 5. The same reference numbers are used again to denote its components.

The hexagonal beam forming network CFH has a "2D" layout, i.e. in a plane, for example on a printed circuit board PCB. It includes three layers of "MMICs" respectively combining the cells 4, the cells 11 though 33 of the first row and the cells 14 through 36 of the third row. The lines interconnecting the sets 4*a* and $CLC_1$ through $CLC_3$ are implemented in the multilayer technology. Examples of practical implementation are described in detail below.

In reality this approach could be applied to more complex beam forming networks, typically with dimensions up to 144×144. The mass and the dimensions would then be reduced to the strict minimum, in the order of hundreds of grams and the size of a standard printed circuit board, respectively.

FIG. 6 shows one example of the physical layout of a larger hexagonal beam forming network CFH of the invention (the second case mentioned above). To give a more concrete idea of this layout, and to avoid making the description excessively complicated, the same example as previously is used, i.e. a 27×27 hexagonal beam forming network CFH as described with reference to FIG. 5. It will be assumed, however, that not all the cells of a level can be integrated in a single "MMlC".

The connections between the two circuit layers: the set 4, on the one hand, and the sets 1 through 3, on the other hand, can be made simply by connectors $C_1$ through $C_3$. In the example shown in FIG. 16, the unit cells 41 through 49 of the first circuit layer are disposed on the equivalent number of plane supports (printed circuit boards, for example), all of which are parallel. One embodiment is described in detail below, in conjunction with the description of FIG. 18. The three sets 1 through 3 constituting the second circuit layer are each disposed on a support, also a plane support. These three planes are at right angles to the plane formed by the supports of the cells 41 through 49. As already mentioned, the first outputs of all the cells of the set 4 are connected only to the inputs of the set 1, the second outputs to the inputs of the set 2 and the third outputs to the inputs of the set 3. In this case it is therefore a simple matter to effect the connection routing that connects the first circuit layer (set 4) to the second circuit layer (sets 1 to 3), since the respective supports are in orthogonal planes. In practice the connectors $C_1$ through $C_3$ can be attached to the supports of the cells 41 through 49. It is then sufficient to plug the three supports of the sets 1 through 3 into these connectors. No crossover connections are needed.

Figure 17:
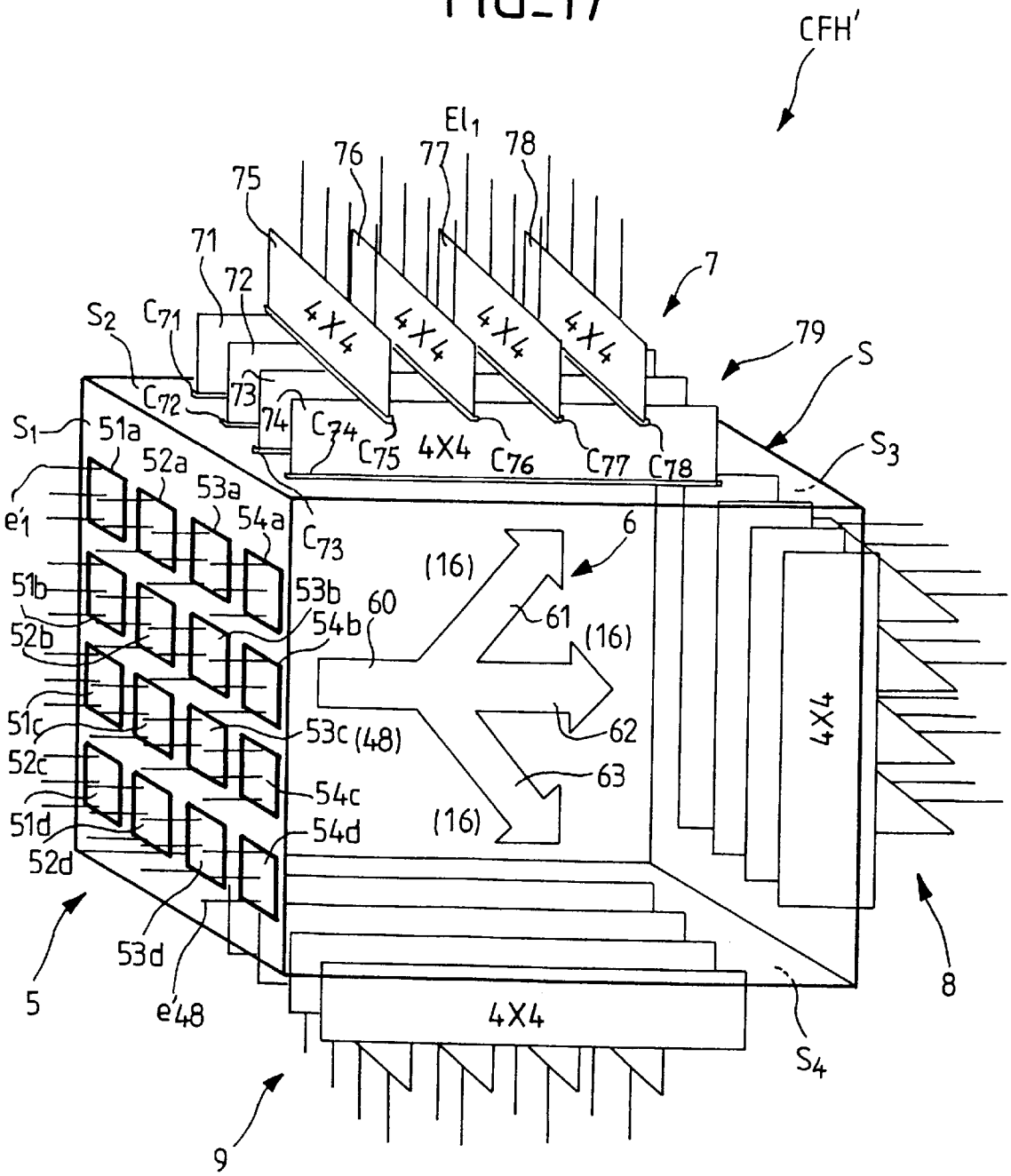
FIG. 17 is a diagram showing a third example of the physical layout of this beam forming network which is particularly suitable for a very large beam forming network.

Finally, FIG. 17 shows one example of a layout for a very large hexagonal bean forming network . To give a more concrete idea of this layout, and to avoid making the description excessively complicated, the same example as previously is used, i.e. a 48×48 hexagonal beam forming network CFH as described with reference to FIG. 11. It will be assumed, however, that it is not possible to integrate all of the cells of one level on a single "MMIC".

The mechanical layout of this 48×48 hexagonal beam forming network CFH' is not so simple as that for a less complex beam forming network, for example that described with reference to FIG. 16, although the same conventions are used for the references as are used in that figure.

The layout is constructed on the faces of a cubic support S. The sixteen 4×4 "DFT" modules can be grouped together on a first face $S_1$ of this cube and rearranged in the form of a matrix comprising four rows and four columns of nodules: 51*a*–54*a*, 51*b*–54*b*, 51*c*–54*c* and 51*d*–54*d*, respectively. Each module has three input connections of which only two ($e'_1$ and $e_{48}$) are shown in order to avoid unnecessary over complication of the diagram.

The three sets 7, 8 and 9 of the second circuit layer are disposed on three faces of the cube, for example the top face (in the figure) $S_2$, the face $S_3$ opposite the face $S_1$ and the bottom face $S_4$.

These faces are advantageously provided with four parallel connectors into which plug rectangular parallelepiped-shape boards supporting modules 71–74, 81–84 and 91–94 for the sets 7, 8 and 9, respectively. To avoid over complicating the figure unnecessarily, only the layout on the face $S_2$ has been shown in detail and with reference numbers (set 7). However, it must be understood that this arrangement is repeated similarly on the faces $S_3$ and $S_4$ for the sets 8 and 9.

The connectors fixed to the face $S_2$ are labelled $C_{71}$ through $C_{74}$. Into each of these connectors is plugged a board supporting modules 71 through 74, respectively. The routing of the connections (79, 89 and 99) between the first row of modules and the second row of modules enables this routing to be physically implemented in a very simple fashion. All that is required is to implement these modules (for examples the modules 75 though 78) also in the form of boards. Your rows of connectors $C_{75}$ through $C_{78}$ of the boards supporting the modules 71 through 74 are attached to the opposite sides to the connectors $C_{71}$ through $C_{74}$. Also, as shown in the figure, the connectors $C_{75}$ through $C_{78}$ are parallel to each other and orthogonal to the connectors $C_{71}$ through $C_{74}$. A respective one of the boards 75 through 78 plugs into each of these connectors. As already mentioned, this arrangement is repeated for the sets 8 and 9 on the faces $S_3$ and $S_4$. Each module has four output connections. To avoid unnecessarily over complicating the figure, only one of these ($E1'_1$) is shown for each module.

The routing 6 of the connections between the outputs of the modules 51*a* through 54*d* of the set 5, on the one hand, and the inputs of the modules on the first row of the other sets, on the other hand, being more complex than in the situation shown in FIG. 5, they can no longer be simply implemented by means of connectors. The sixteen modules 51*a* through 54*d* comprise 48 outputs in all (four per module) and the connections 6 between the face $S_1$ and the other three faces could be made by means of 48 coaxial cables, for example. The outgoing harness 60 of 48 cables splits into three sub-harnesses each of 16 cables: 61, 62 and 63, distributed to the inputs of the modules of the sets 7, 8 and 9, respectively. As the person skilled in the art is well aware, these cables must be matched in terms of phase and insertion losses. Their materials will also be chosen for good temperature stability.

This hardware layout can be extended to more complex beam forming networks. As the latter become larger, the two previously unused faces of the cube can be used. If the complexity increases further, a polyhedron can be used rather than a cube. The structure of the unit cells constituting the modules naturally evolves in line with the complexity of the hexagonal beam forming network.

Figure 16:
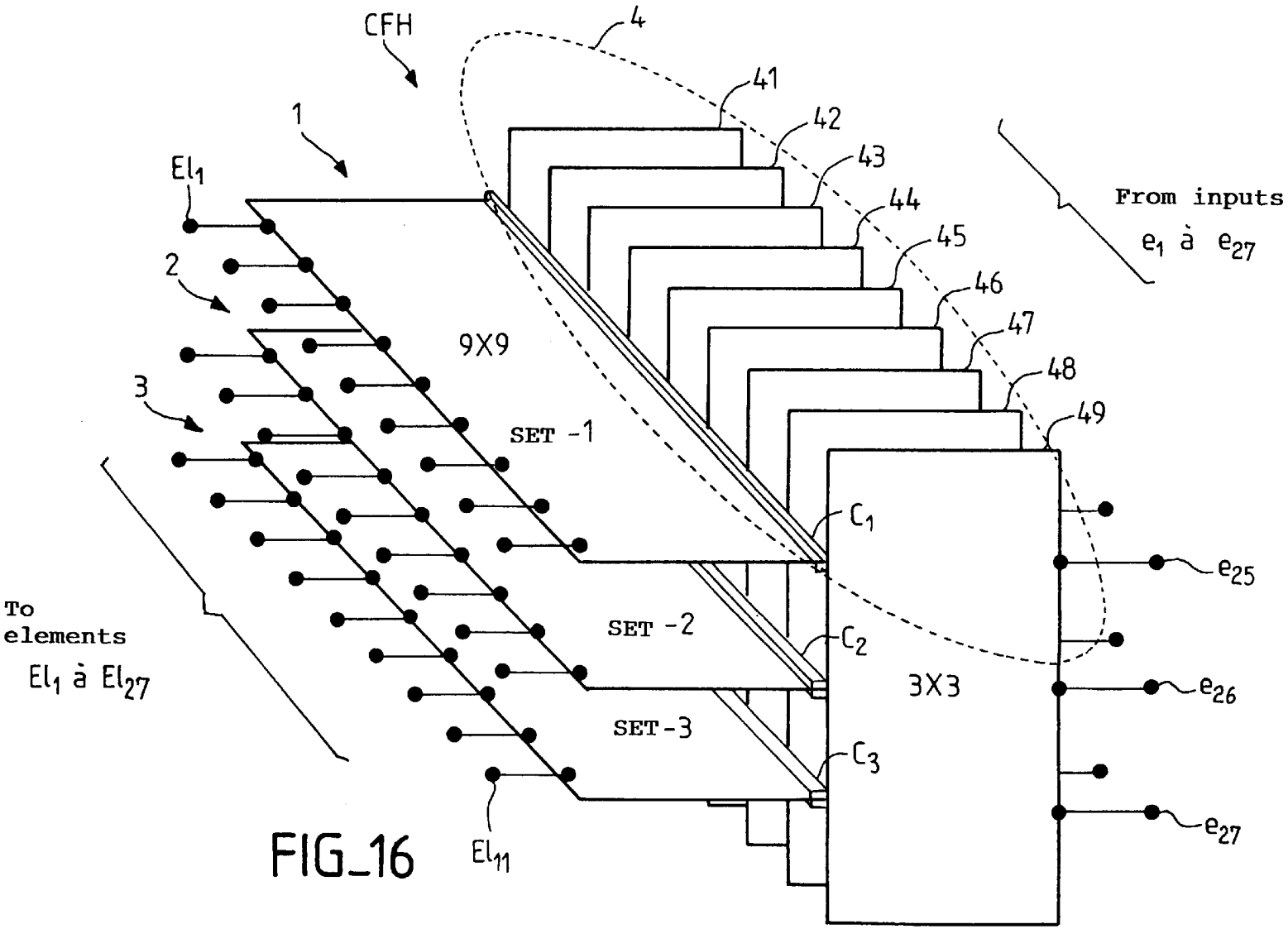
FIG. 16 is a diagram showing a second example of the physical layout of a beam forming network that is particularly suitable for a large beam forming network.

To summarize, it must be understood that the hardware structure of the hexagonal beam forming network shown in FIG. 16 (which is a 27×27 network in the example shown) is a special "limiting" case relative to the more general structure shown in FIG. 17. In this particular case, the supporting structure has been reduced to its simplest expression, i.e. a plane. The connectors $C_1$ through $C_3$ have a function similar to that of the connectors $C_{74}$ through $C_{78}$. There is no longer any benefit in using a harness of coaxial cables, since it is possible to make direct connections between the cells of the first circuit layer (4) and the second circuit layer (1 through 3). The modules of the second and third levels are disposed on a single board, given the low complexity of the circuits, and this has made it possible to dispense with take interconnection of these modules by means of connectors as in the 48×48 beam forming network just described (FIG. 17).

For reasons of standardization, a cubic or even polyhedral structure could have been used for the mechanical layout of the 27×27 hexagonal beam forming network. In this case, the modules 41 through 43 (set 4: FIG. 5) would be placed on the face $S_1$ and the modules of the sets 1 through 3 (FIG. 5) on the faces $S_2$ through $S_3$, respectively. Similarly, the second and third levels could be dissociated from each other. The interconnections would then be made using connectors having a similar function to the connectors $C_{71}$ through $C_{78}$. The interconnections between the modules of the set 4 and the other modules could then also be made using coaxial cables. Note, however, that although this structure conforms to the teaching of the invention, it would be more complex than that described with reference to FIG. 16.

A hexagonal beam forming network with $N_t=R\times N^2$ inputs, where R and N are integers, is constituted in the following manner, using a polyhedron structure:

a) A row of $N^2$ R×R order one-dimensional "DFT" cells. This row is disposed on one face of the polyhedron structure. The cells can naturally be rearranged on this face into a row/column matrix organization as shown in FIG. 12. Each cell can be implemented in the form of modules comprising one or more GaAs "MMIC" (see FIG. 7 or 11, for example).

b) R independent. sets of one-dimensional "DFT" cells, each comprising two rows (second and third levels) of N N×N order cells. Each of these R independent sets is disposed on one of the remaining faces of the polyhedron structure. Also, each of these sets is in the form of a stack of modules with two stages. The first stage comprises the N cells of the first row, each plugged into a connector carried by the aforementioned face. The second stage comprises the N modules of the second row, each plugged into a connector carried by the modules of the second row, the connectors of the first and second stages being mutually orthogonal, as shown in FIG. 17.

The material constituting the cubic (or more generally polyhedron) structure must provide a support. Various materials can be chosen. A light material such as aluminum will be selected.

If the "switching" function is to be incorporated (see FIG. 6), the complexity of the switching matrix is subject to the same rules, as stated previously. These are M×M square matrices with M=N or M=R, according to whether they are connected to the inputs of N×N or R×R cells.

The second stage connectors make the necessary interconnections between the second and third level modules, in an entirely similar manner to that described with reference to FIG. 17. The interconnections between the outputs of the $N^2$ modules of the first level and the inputs of the other modules require $N_t$ links (trellis). As previously, they can be made by means of $N_t$ coaxial cables matched in terms of phase and insertion loss and made from temperature stable materials.

For the interconnections between the first and second levels, the general rule may be stated as follows: the outputs of rank i of each cell are each connected to one of the cell inputs of the independent set with the same rank, with $i\epsilon\{1, R\}$. Similarly, for the connections between the cells of the first and second rows in each of the R independent sets of cells, the rule is: the output of rank j of each first row cell is connected to an input of the cell of the same rank in the second row, with $j\epsilon\{1, N\}$. These rules merely generalize what has been explained in detail with reference to FIGS. 5 and 11.

Figure 14:
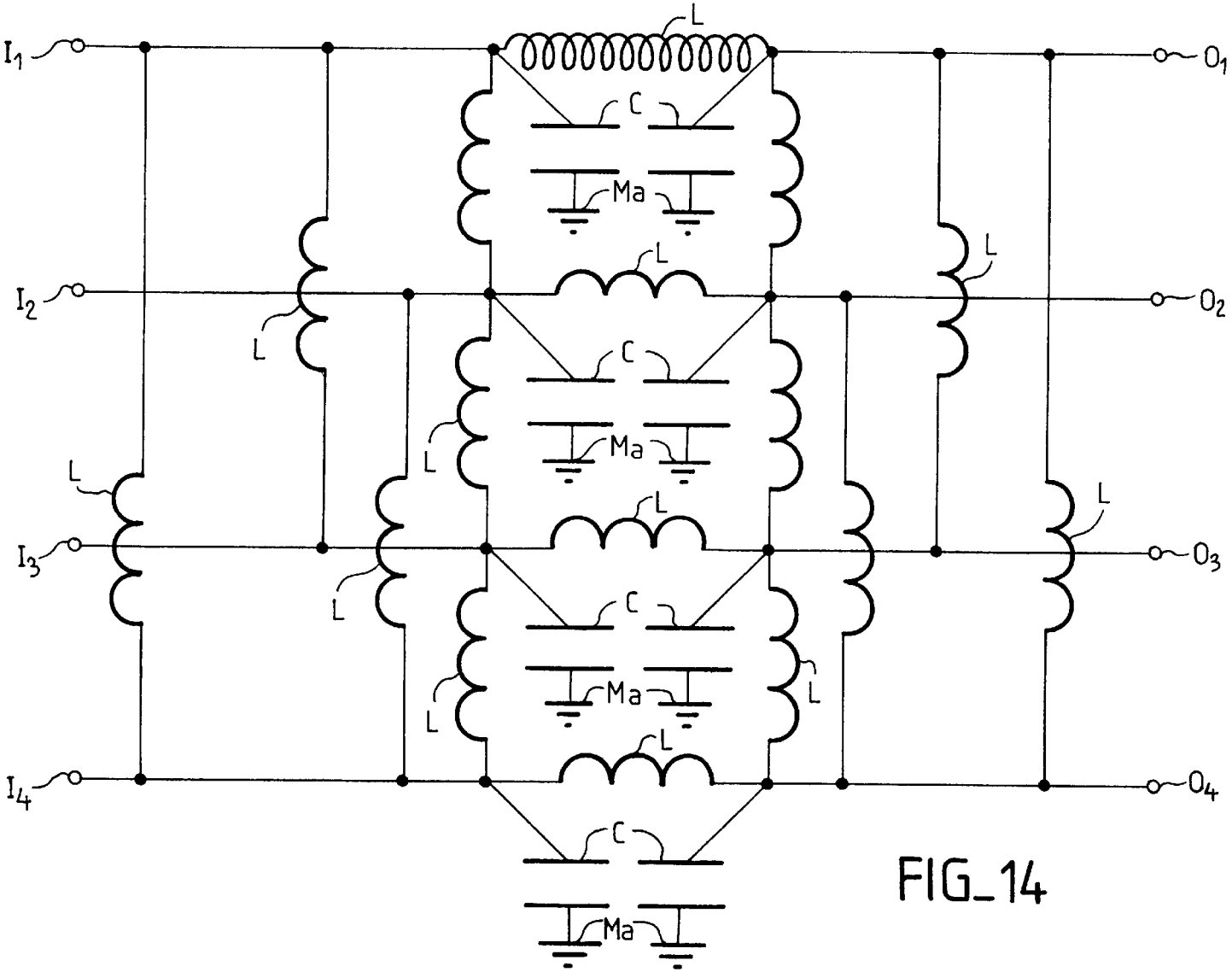
FIG. 14 shows the topology of the circuits of a second embodiment of a 4×4 unit cell used repetitively to implement the beam forming network of FIG. 11.

Finally, if the degree of integration can be further increased, in particular by using 3×3 or 4×4 cells laid out as shown in FIGS. 9 and 14, respectively, all of the hexagonal beam forming network can be laid out on a single multilayer printed circuit board.

The additional phase-shifters between levels have not been considered but, as already stated, they can be integrated into the modules or, at least, implemented on the circuit boards carrying the modules.

With reference to the routing of connections within the modules, those are difficult to implement using planar techniques because of the requirement for the connections to cross over, in the case of a single plane.

Consideration can naturally be given to the use of jumper links or similar devices. This solution would degrade the radiofrequency insulation, however.

To solve this problem the multilayer planar technology can be used with radiofrequency feed-throughs.

Figure 18:
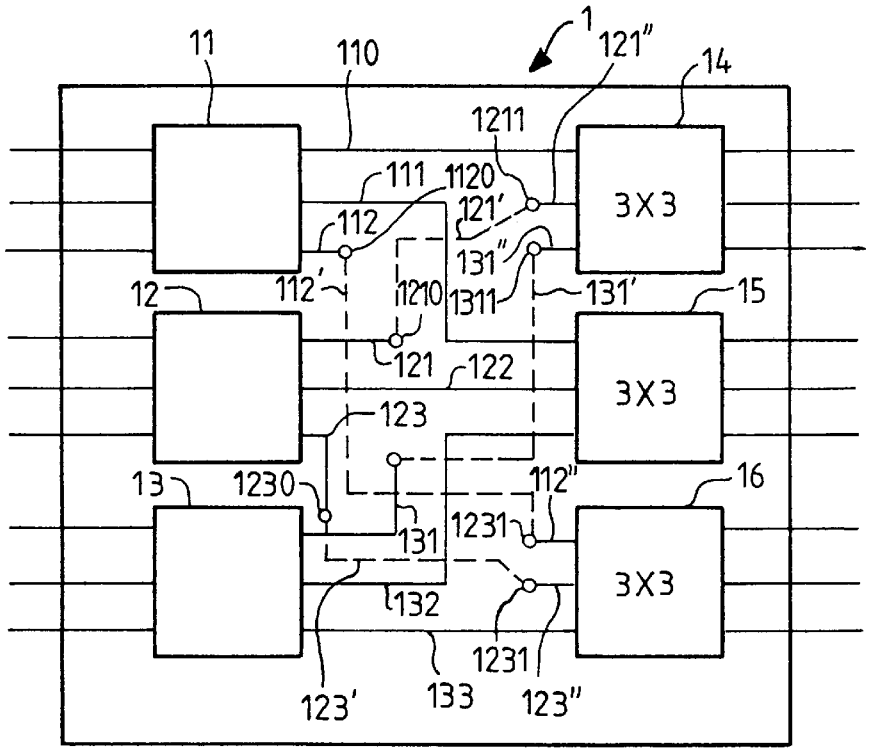
FIG. 18 shows the routing of interconnections utilizing planar technology.

FIG. 18 shows an arrangement of this kind. It shows, by way of example, the module set 1 from FIG. 5. This set comprises two rows of three 3×3 one-dimensional "DFT" cells: 11–33 and 14–16, respectively. It is assumed that it is implemented on a single support which is not differentiated from the set 1 itself.

There is no problem in regard of the inputs-outputs of the module set 1, since there are no crossovers.

On the other hand, the connections between the modules of the two rows are effected by means of transmission lines disposed on two levels of a dielectric. The latter also supports the cells or modules 11 through 16. The connections 110 (cell 11 to cell 14), 111 (cell 11 to cell 15), 122 (cell 12 to cell 15), 132 (cell 13 to cell 15) and 133 (cell 13 to cell 16) occupy only one level (top plane). On the other hand, the connections 112 (cell 11 to cell 16), 121 (cell 12 to cell 14). 123 (cell 12 to cell 16) and 131 (cell 13 to cell 14) occupy two levels (top and bottom planes). Each of these connections is divided into three sections: 112—121'—112", 121—121'—121", 123—123'—123", and 131—131'—131", respectively . The "bottom" transmission lines are connected to the "top" transmission lines by means of radiofrequency feed-throughs: 1120–1121, 1210–1211, 1230–1231 and 1310–1311, respectively.

Given the range of frequencies employed, the dielectric material is of the "soft" substrate type. To be more precise, the material used can be PTFE, for example, optionally filled with ceramic or alumina.

As is well known in itself, matching components or circuits may be needed near the radiofrequency feed-throughs.

Various technologies can be utilized.

Figure 19:
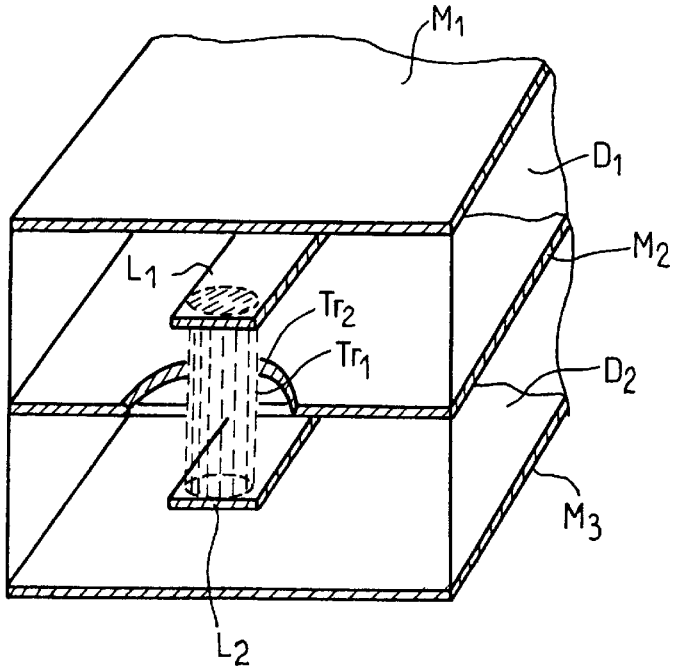
FIG. 19 shows one embodiment of a stripline type transmission line that can be used as a connecting unit.

FIG. 19 shows one of these technologies. The lines are of the stripline type, in thick or thin film technology depending on the precise application and the fabrication methods used. The component shown in cross-section in this figure comprises three parallel metal ground planes $PM_1$ and $PM_2$ and $PM_3$ and two dielectric material layers $D_1$ and $D_2$ between these ground planes, forming supports. Two metal striplines, a top line $L_1$ and a bottom line $L_2$, are buried in the respective dielectric supports $D_1$ and $D_2$. Where a connection must be made between the lines $L_1$ and $L_2$ a radiofrequency feed-through $Tr_1$ is provided in the form of a plated-through hole. Naturally, an orifice of greater diameter (or more generally of greater size) is provided in the intermediate ground plane $M_2$. The latter provides radiofrequency shielding between the two lines $L_1$ and $L_2$. This arrangement therefore provides a very high level of radiofrequency insulation.

Another solution, not shown, would be to use a waveguide type line on one level. and a stripline type line on the other level. This solution offers the minimum complexity, but the radiofrequency insulation is not as good as that available with striplines. Nevertheless, a sufficient degree of insulation can be achieved by increasing the thickness of the dielectric.

Other solutions are possible. In all cases, two levels of transmission lines are needed to route the interconnections, with a high degree of radiofrequency insulation between the lines and low losses at the feed-throughs. Depending on the frequency ranges employed, thin or thick film technologies, flexible material or ceramic substrates and plated-through hole or pin type radiofrequency feed-throughs are used.

Finally, in the case of very great complexity, other solutions have to be adopted: connectors, coaxial cables, etc, as explained with reference to FIG. 17.

In the case of a hexagonal grid antenna, the mass of the hexagonal beam forming network can be estimated as follows:

$$\text{Mass}=(N_r\times M_r)+(N_n\times M_n)+(N_t\times M_c) \quad (45)$$

where:

$N_r$ is the number of R×R unit modules;

$M_r$ is the mass of each of these modules, including casings and connectors;

$N_n$ is the number of NxN unit modules;

$M_n$ is the mass of each of these modules, including casings and connectors;

$N_r$ is the total number of inputs of the hexagonal beam forming network;

$M_c$ is the mass of a coaxial cable, including terminating connectors.

To give a definite example, in the case of a 48×48 beam forming network laid out as shown in FIG. 17, with R=3 and N=4, using the proposed technology, and with the following estimates: $M_r$=25 g, $M_n$=35 g and $M_c$=20 g, the total mass would be approximately 2.2 kg.

The mass per "BFN" node is less than 1 g. The number of nodes is defined as the product of the number of beams by the number of radiating elements. In the prior art, a figure of 10 g per node is routinely accepted as the reference for estimates of the total mass of radiofrequency beam forming networks using the usual technologies in this art.

The architecture of the invention therefore reduces the total mass by a ratio of approximately 1 to 10.

It must be clear that the invention is not limited to the embodiment described in detail, in particular with reference to FIGS. 2 through 19. In particular, the integration of the unit cells into modules can be affected using other technologies. As demonstrated, the interconnections can also be made using various technologies: multilayer, coaxial cables, etc.

Nor is the shape of the antennas limited to hexagonal grid antennas. The beam forming network of the invention can also be used to drive a triangular grid antenna with patches that are neither contiguous nor hexagonal at its periphery.

Finally, it is possible to dispose between the beam forming network and the radiating elements of the antenna conventional amplitude weighting means, including the special case of zero weighting (for radiating elements that are not present), which provides a very simple way of shaping beams with a large degree of overlap.

Although particularly well suited to space applications, the invention is not limited to this type of application. It applies to all radiofrequency phased array antennas for generating multiple beams.

There is claimed:

1. A beam forming network for radiofrequency antennas comprising a particular number of radiating elements for generating; multiple beams, a particular number of signal inputs, a number of outputs for control signals for said radiating elements equal to said predetermined number of signal inputs and applying to the input signals a two-dimensional hexagonal discrete Fourier transform, wherein said predetermined number of inputs and outputs being equal to $N_t$ with $N_t=R\times N^2$, R and N being integers, the circuits constituting said beam forming network are divided between first and second circuit layers respectively effecting a row one-dimensional discrete Fourier transform and a column one-dimensional discrete Fourier transform;

the first circuit layer comprises a row of $N^2$ cells each having R inputs and R outputs, each cell receiving a signal present at one of said $N_t$ inputs and applying to the signals present at its R inputs a one-dimensional discrete Fourier transform;

the second circuit layer comprises R independent sets of cells each having N inputs and N outputs, each set including a first row and a second row of N cells, each cell applying to the signals present at its N inputs a one-dimensional discrete Fourier transform; each of the outputs of the cells of said second row driving one of said radiating elements;

said first and second circuit layers are connected by a first set of interconnections providing connections between the outputs of the cells of said row of $N^2$ cells and the inputs of the N cells of the first row of the R independent sets of cells; the outputs of rank i of each cell being each connected to one of the cell inputs of the independent set of the same rank; with $i\epsilon\{1, R\}$;

and said first and second rows of cells of each of said R independent sets are connected by a second set of interconnections providing connections between the outputs of the N cells of the first row and the inputs of the N cells of the second row; the output of rank j of each cell of the first rank being connected to an input of the cell of the same rank in the second row; with $j\epsilon\{1, N\}$.

2. A network according to claim 1 further comprising beam switching circuit matrices and wherein said circuits are divided between a first layer disposed between said particular number of signal inputs and said first layer of $N^2$ cells, a second layer disposed between the outputs of said first set of interconnections and the cells of the first row of said R independent sets, and a third layer disposed between the outputs of said second set of interconnections and the cells of the second row of said R independent sets.

3. A network according to claim 2 wherein the switching matrices are square matrices, the switching matrices of the first layer are R×R matrices and the matrices of the second and third layers are N×N matrices.

4. A network according to claim 1 wherein, $N_t$ being equal to 27, N being equal to 3 and R being equal to 3, all the cells effecting the one-dimensional discrete Fourier transform are identical and have three inputs and three outputs.

5. A network according to claim 1 wherein, $N_t$ being equal to 48, N being equal to 4 and R being equal to 3, all the cells effecting the one-dimensional discrete Fourier transform of said row of $N^2$ cells are identical and have three inputs and three outputs and all the cells effecting the one-dimensional discrete Fourier transform of the first and second rows of said R independent sets are identical and have four inputs and four outputs.

6. A network according to claim 1 wherein said cells effecting a discrete fourier transform are in the form of at least one gallium arsenide monolithic microwave integrated circuit.

7. A network according to claim 6 wherein said integrated circuits are hybrid technology passive circuits based on capacitors and inductors with lumped constants in the L or S frequency band.

8. A network according to claim 7 wherein said cells being X×X cells, where X is an integer equal to N or to R, said cells are implemented by connecting each input to an output of the same rank via an inductor of particular value, by connecting each input to the other inputs via an inductor of the same particular value, by connecting each output to the other outputs via an inductor of the same particular value, and by connecting each input and each output to ground potential via capacitors having the same first particular value.

9. A network according to claim 8 wherein each capacitor comprises a fixed capacitor having a second particular value less than said first particular value in parallel with an MESFET type transistor the gate of which is connected to said fixed capacitor and the source and drain of which are connected to ground potential to form a variable capacitance and a control voltage is applied to the gate to modify the value of the composite capacitance formed by said fixed capacitor and said transistor in order to obtain said first particular value.

10. A network according to claim 9 wherein said control voltage is a single control voltage applied to all the cells.

11. A network according to claim 6 wherein said integrated circuits are mounted on dielectric material substrates and interconnections between integrated circuits are effected by means of multilayer transmission lines, the connections between layers being effected by means of radiofrequency feed-throughs.

12. A network according to claim 11 wherein said transmission lines are in the form of microstrip lines comprising first and second external metal ground planes, an intermediate ground plane disposed between the first and second metal ground planes and forming a shield between said transmission lines, the three planes are parallel, the volume between the metal ground planes and the intermediate plane is filled with a dielectric material, said transmission lines are constituted of metal strips buried in the dielectric materials and disposed parallel to said planes, and the interconnections between the lines are made by means of plated-through holes forming radiofrequency feed-throughs, said intermediate plane including openings of greater size than said feed-throughs to provide free passage for said feed-throughs.

13. A structure for mechanical layout of a network according to claim 1 wherein, said cells being in the form of monolithic microwave integrated circuits, they are mounted on a multilayer printed circuit board and said first and second sets of interconnections are in the form of multilayer transmission lines on said printed circuit board.

14. A structure for mechanical layout of a network according to claim 1 comprising a frame in the form of a polyhedron, and wherein the cells of said row of $N^2$ cells are disposed on a first face of said polyhedron and each of said R independent sets is disposed on one of the R remaining faces of said polyhedron.

15. A structure according to claim 14 wherein said $N^2$ cells are disposed on said first face of the polyhedron in a matrix configuration with N columns and N rows.

16. A structure according to claim 14 wherein, the cells of the first and second rows of said R independent sets being in the form of monolithic microwave integrated circuits, each cell is disposed on a rectangular parallelepiped-shape plane substrate, the faces on which said R sets are disposed are each provided with a first set of N parallel connectors into each of which plugs one of said plane substrates supporting a cell of the first row so as to constitute with $N_L$ additional connection lines said first set of interconnections making connections between the outputs of the cells of said row of $N^2$ cells and the inputs of the N cells of the first row of the R independent sets of cells, and said substrates carry on the side opposite the side inserted into the connectors a second set of N connectors, parallel to each other and orthogonal to the connectors of said first set, to constitute said second set of interconnections making direct connections between the outputs of the N cells of the first row and the inputs of the N cells of the second row.

17. A structure according to claim 16 wherein said $N_L$ additional connection lines are coaxial cables a first end of which is connected to one of the outputs of the cells of said row of $N^2$ cells and the second end of which is connected to one of the inputs of the N cells of the first rows of said R independent sets via one of said connectors of the first set carried by one of the faces of said polyhedron.

18. A structure according to claim 14 wherein, R being less than or equal to 5, said structure is a cube.

19. A structure for mechanical layout of a network according to claim 1 wherein, $N_t$ being equal to 27, N being equal to 3 and R being equal to 3, the cells being in the form of monolithic microwave integrated circuits, each cell of said row of $N^2$ cells is disposed on an independent rectangular parallelepiped-shape plane substrate, said N plane substrates being parallel, the cells of each of said R independent sets are disposed on a common rectangular parallelepiped-shape plane substrate, said R plane substrates being parallel, said N plane substrates are orthogonal to said R plane substrates, and said N plane substrates carry on one side R connectors into each of which plugs one of said R plane substrates to form said first set of connections.

20. A structure according to claim 19 wherein said second set of connections is formed by multilayer transmission lines between cells of the first and second rows of said R independent sets, the connections between layers being provided by radiofrequency feed-throughs.

21. An application of a network according to claim 1 to control of radiofrequency phased array antennas for generating multiple beams.

22. An application according to claim 21 wherein the radiating elements of said antenna are disposed in a hexagonal grid and the antenna is on board a satellite.

* * * * *